US008215854B2

(12) United States Patent
Kubota et al.

(10) Patent No.: US 8,215,854 B2
(45) Date of Patent: Jul. 10, 2012

(54) PRINTER CARTRIDGE, CARTRIDGE INSTALLATION DETECTION METHOD AND PRINTER APPARATUS

(75) Inventors: Tsuyoshi Kubota, Kai (JP); Toshiro Fujimoto, Minami-alps (JP)

(73) Assignee: Nisca Corporation, Minamikoma-Gun, Yamanashi-Ken (JP)

( * ) Notice: Subject to any disclaimer, the term of this patent is extended or adjusted under 35 U.S.C. 154(b) by 1203 days.

(21) Appl. No.: 12/010,445

(22) Filed: Jan. 25, 2008

(65) Prior Publication Data

US 2008/0286026 A1 Nov. 20, 2008

(30) Foreign Application Priority Data

Jan. 25, 2007 (JP) ..... 2007-015205
Jan. 31, 2007 (JP) ..... 2007-021434

(51) Int. Cl.
*B41J 32/00* (2006.01)
*B41J 35/28* (2006.01)
*B65H 75/00* (2006.01)

(52) U.S. Cl. ..... 400/207; 400/208; 400/242; 347/214; 360/94; 360/96.51

(58) Field of Classification Search ..... 400/207–208, 400/242, 194–196.1, 246; 347/214; 360/94, 360/96.15

See application file for complete search history.

(56) References Cited

U.S. PATENT DOCUMENTS 5,501,536 A * 3/1996 Kleve ..... 400/208
2005/0231847 A1* 10/2005 Rathweg et al. ..... 360/96.5

FOREIGN PATENT DOCUMENTS

| | | | |
|---|---|---|---|
| JP | 05-092650 | * | 4/1993 |
| JP | 05-155122 | * | 6/1993 |
| JP | H05-139013 | | 6/1993 |
| JP | H09-115010 | | 5/1997 |
| JP | 2006-062278 | | 3/2006 |

* cited by examiner

*Primary Examiner* — Ren Yan
*Assistant Examiner* — Marissa Ferguson Samreth
(74) *Attorney, Agent, or Firm* — Manabu Kanesaka

(57) ABSTRACT

A cartridge detachably attached to a printer apparatus includes a casing, an ink ribbon provided in the casing, a supply spool provided in the casing for supplying the ink ribbon, and a take-up spool provided in the casing for retrieving the ink ribbon. The printer apparatus includes a locking member rotatably supported on the printer apparatus and locking the cartridge to the printer apparatus, a detection device for detecting an installation of the cartridge by detecting a locked state of the locking member, a locking portion for locking the locking member when the cartridge is installed in the printer apparatus, and a guide forcefully and rotatingly displacing the locking member from a locking position when the cartridge is pulled out from the printer apparatus.

10 Claims, 18 Drawing Sheets

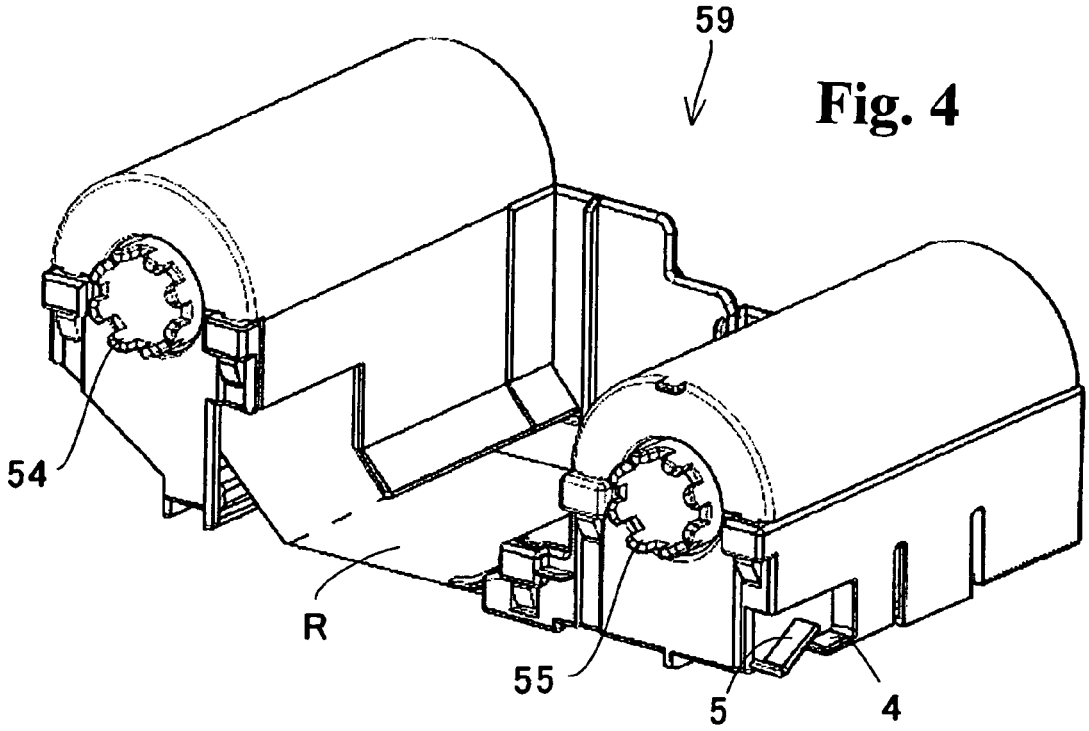
Fig. 4
Fig. 5
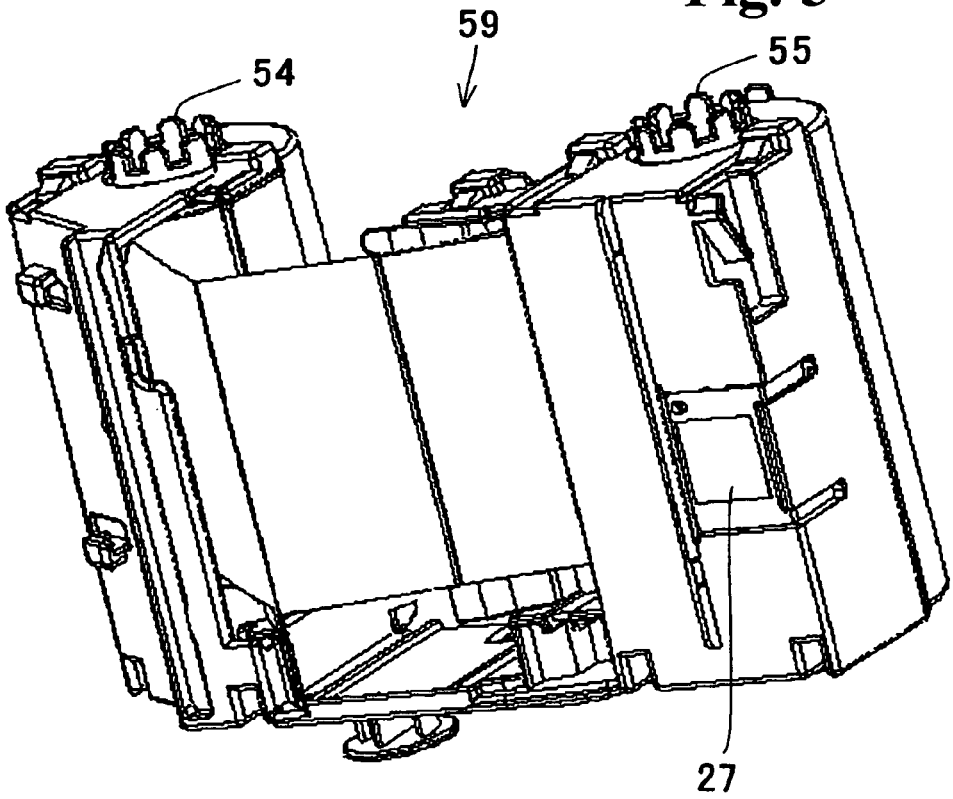

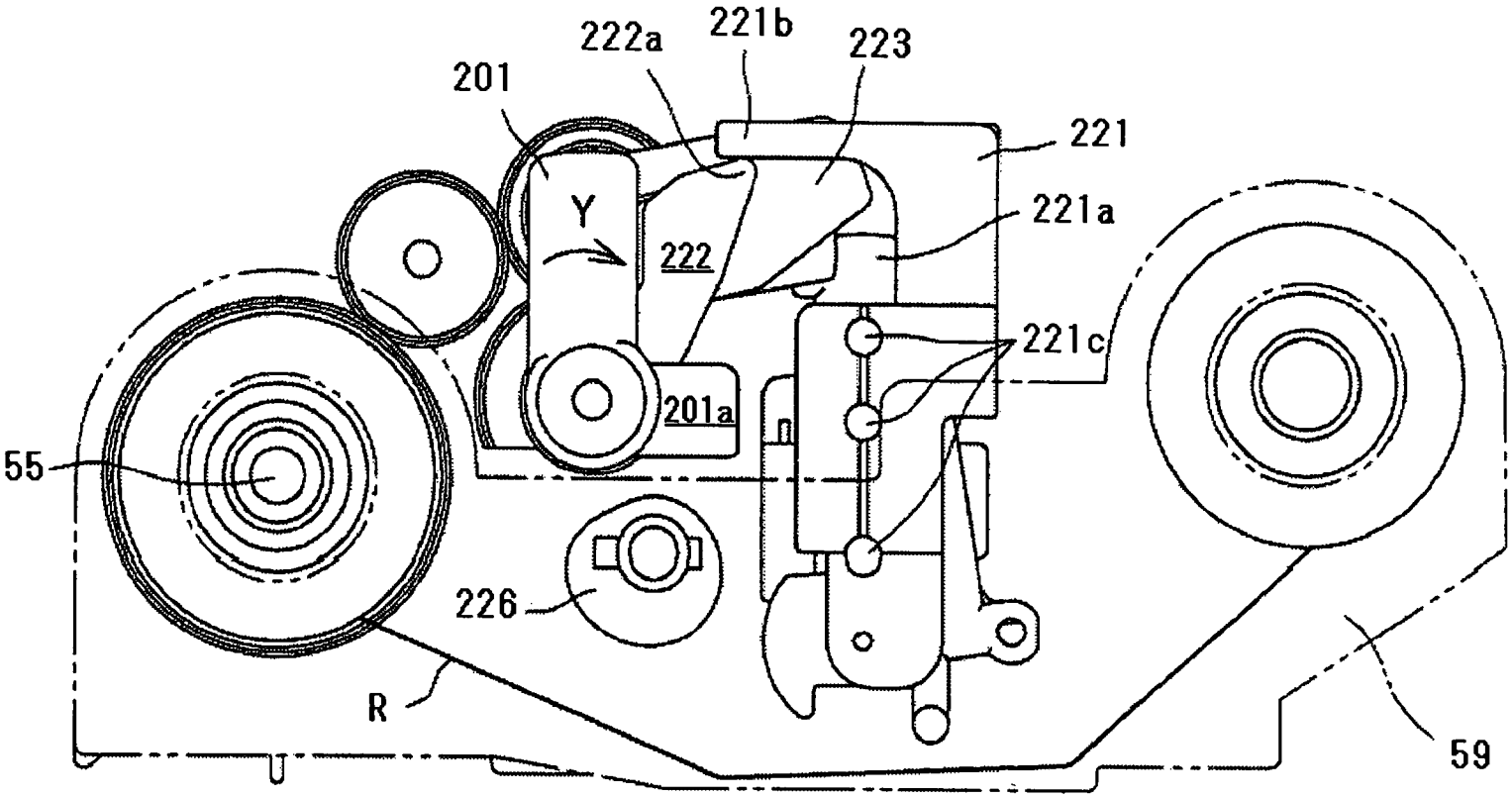
Fig. 18
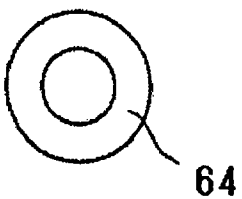

PRINTER CARTRIDGE, CARTRIDGE INSTALLATION DETECTION METHOD AND PRINTER APPARATUS

BACKGROUND OF THE INVENTION AND RELATED ART STATEMENT

The present invention relates to printer cartridges, installation detection methods of printer cartridges in a printer apparatus, and printer apparatuses.

Conventionally, printer apparatuses selectively heat an ink ribbon housed in a cartridge at a printing unit having a print head and the like to print images or characters to recording media. Generally, the ink ribbon used in the printer apparatus includes sequential bands of colors, such as Y (yellow), M (magenta), C (cyan) and Bk (black) in the ribbon retrieving direction. Thus, color printing is performed when printing at the printing unit by selecting the proper colors from the ink ribbon.

Therefore, it is necessary to control positions of the colors on the ink ribbon with such printing apparatuses. When the cartridge that houses the ink ribbon is installed in the apparatus, a predetermined color on the ink ribbon is arranged at a predetermined printing position. For that reason, it is necessary to detect whether the cartridge has been pulled out from the apparatus. Furthermore, each time the cartridge is detected, a predetermined color on the ink ribbon must be positioned at the printing position.

As disclosed in Japanese Unexamined Patent Application Publication Number H05-139013, Japanese Patent Number 3330476 and Japanese Unexamined Patent Application Publication Number 2006-62278, various mechanisms have been proposed to detect the detachment or installation of a cartridge in the printer apparatus.

However, with each of the mechanisms proposed in the publications listed above, the system returns to a state prior to the installation of a cartridge even in a reinstalled state. In that state, it is not possible to detect whether the cartridge has been pulled out (uninstalled). For this reason, conventionally, the installation of the cartridge was determined and the ink ribbon had to be positioned every time the system was recovered after the power was turned on or after a problem had occurred in relation to the power supply. Therefore, by repeating the positioning of the ink ribbon, ink ribbons had to be replaced frequently which caused the problem that the user has to bear unnecessary running costs.

In view of the problems associated with the prior art, an object of the present invention is to provide a printer apparatus that suppresses unnecessary positioning of the ink ribbon to enable effective use of the ink ribbon, an installation detection method for a cartridge installed in the apparatus, and a cartridge that can be installed and removed from the apparatus.

Further objects and advantages of the invention will be apparent from the following description of the invention.

SUMMARY OF THE INVENTION

In view of the problems stated above, a first aspect of the present invention is a printer cartridge that can be installed to a printer apparatus equipped with a detection mechanism that detects the installation of the cartridge by detecting a locked state of a locking member rotatably supported in the printer. The printer cartridge comprises a locking unit that locks a locking member when the cartridge is installed in the printer apparatus, and a guide that forcefully rotatingly displaces the locking member from a locked position when the cartridge is pulled out from the printer.

In this embodiment, the locking portion is disposed in a front side, and the guide is disposed in a back side along the direction of cartridge insertion. When the cartridge is pulled out from the printer, the locking member is unlocked from the locking portion and the locking member is rotatingly displaced from the locking position by the guide.

A second aspect of the present invention is an installation detection method of a cartridge for a printer installed on a printer apparatus equipped with a detection sensor that detects installation of a cartridge for the printer; a locking member that rotatably locks the cartridge; a target member integrally rotatable with the locking member detected by the detection sensor when the locking member is locked in the cartridge; and a determining means that determines the installation of the cartridge according to output of the detection sensor.

With this detection method, in the process to pull out the cartridge from the main apparatus, the lock of the locking member to the cartridge is released, and the target member moves from a first position where it is detected by the detection sensor to a second position where it is not detected by the detection sensor. In the process to install a cartridge in the main apparatus, the target member is maintained at the second position with the locking member at a non-locked state to the cartridge.

In a process to determine whether the cartridge is installed or uninstalled with the cartridge installed in the main apparatus, the determining means determines that the cartridge has not been removed when the detection sensor detects that the target member is at the first position, and that the cartridge has been removed when the detection sensor does not detect the target member.

In a detection process of this embodiment, it is preferred to also include a rotating process to rotate the locking member and target member so that the locking member locks the cartridge mounted in the apparatus, and the target member is positioned at the first position after the determining means determines that the cartridge has been pulled out.

In a printer apparatus to which a printer cartridge can be installed and which prints images and/or characters on a recording media using an ink ribbon in the cartridge, a third aspect of the present invention provides a detection sensor that detects installation of a cartridge; a locking member that rotatably locks the cartridge; a target member integrally rotatable with the locking member, detected by the detection sensor when the locking member is locked in the cartridge; and a determining means that determines the installation of the cartridge according to output of the detection sensor.

When the cartridge has been pulled from the apparatus, the lock of the locking member to the cartridge is released, and the target member moves from a first position where it is detected by the detection sensor to a second position where it is not detected by the detection sensor. When the cartridge is installed in the main apparatus, the target member is maintained at the second position with the locking member at a non-locked state to the cartridge. The determining means determines that the cartridge has not been removed when the detection sensor detects that the target member is at the first position, and determines that the cartridge has been removed when the detection sensor does not detect the target member.

In this embodiment, when the cartridge is installed in the apparatus, the locking member is locked on the cartridge; the detection sensor detects the target member located at the first position; and the determining means determines that the cartridge has not been pulled out. If the cartridge has been removed from the apparatus, and when the removed cartridge or a different cartridge is reinstalled in the apparatus, the locking member enters a non-locked state on the cartridge, and the target member is maintained at the second position.

Therefore, the detection sensor does not detect the target member, so that the determining means determines that the cartridge has been removed. According to this embodiment, when the detection sensor has not detected the target member, the determining means determines that the cartridge has been removed. This makes it possible to securely determine that the cartridge has been installed or removed from the apparatus. When a cartridge has been installed to the apparatus, the ink ribbon can be positioned. If the cartridge remains installed in the apparatus, the ink ribbon does not need to be re-positioned. This makes it possible to effectively use the ink ribbon by suppressing unnecessary positioning of the ink ribbon.

In a detection process of this embodiment, it is preferred to also provide a rotating means to rotate the locking member and target member so that the locking member locks to the cartridge mounted in the apparatus, and the target member is positioned at the first position when the determining means determines that the cartridge has been pulled out. The cartridge can have a locking unit that locks the locking member when installed in the apparatus, and it also can have a guide unit that forcefully guides the locking member that shifts from the locked state to the unlocked state when the cartridge is removed from the apparatus. Bands of a plurality of colors are formed on the ink ribbon. When the determining means determines that the cartridge has been removed, it is preferred to cue a predetermined color on the ink ribbon of the cartridge installed in the apparatus at a predetermined position. Also, the ink ribbon and the ink ribbon unit, composed of the supply spool that the ink ribbon is wrapped around and the take-up spool, are installed to the cartridge so the locking member advances to the locking unit at a position where it is possible to lock the locking unit. By pulling the ink ribbon unit from the cartridge, the locking member can retreat from the locking unit where it is not lockable to the locking unit.

Finally, a fourth aspect of the present invention is a printer apparatus to which an ink ribbon, and ink ribbon unit, composed of the supply spool around which the ink ribbon is wound and the take-up spool, are detachable. The printer apparatus prints images and/or characters on a recording media using the installed ink ribbon, and comprises a detection sensor that detects installation of the ink ribbon unit; a locking unit that moves by the installation of the ink ribbon unit; a locking member rotatably locking to the locking unit; a target member integrally rotatable with the locking member, detected by the detection sensor when the locking member is locked in the cartridge; and a determining means that determine the installation of the cartridge according to output of the detection sensor.

When the ink ribbon unit has been pulled from the apparatus, the lock of the locking member to the locking unit is released, and the target member moves from a first position where it is detected by the detection sensor to a second position where it is not detected by the detection sensor. When the ink ribbon unit is installed in the main apparatus, the target member is maintained at the second position with the locking member at a non-locked state to the cartridge. The determining means determines that the ink ribbon unit has not been removed when the detection sensor detects that the target member is at the first position, and determines that the ink ribbon unit has been removed when the detection sensor does not detect the target member.

BRIEF DESCRIPTION OF THE DRAWINGS

FIG. 4 is an external perspective view of a cartridge installed in a printer apparatus of the embodiment;

FIG. 5 is an external perspective view of a backside of the cartridge;

FIGS. 8A to 8E are operational views of the cartridge detection mechanism, wherein FIG. 8A shows the cartridge installed to the apparatus, and the ink ribbon positioned; FIG. 8B shows a cover opened from the state shown in FIG. 8A and the installed cartridge pulled out; FIG. 8C shows the cartridge pulled out from the state shown in FIG. 8B; FIG. 8D shows the cartridge pulled out further from the state shown in FIG. 8C, and the cartridge removed from the apparatus; FIG. 8E shows a cartridge installed again to the apparatus;

FIG. 18 is a front elevation view of the replacement mechanism of the printer apparatus showing the cartridge installed in the apparatus in an unlocked state;

DETAILED DESCRIPTION OF PREFERRED EMBODIMENTS

The following will now explain embodiments of the present invention applied to a printing apparatus having a function to print record characters and images to a card-shaped recording medium (hereinafter simply referred to as a card), and a function to magnetically record to a magnetic strip on the card with reference to the drawings provided.

System Configuration

The printer apparatus of this embodiment is connected to a host apparatus (for example, a host computer such as a personal computer or the like) via an interface, not shown. The host apparatus provides instructions such as recording operations and the like by sending print recording data and magnetic recording data to the printer apparatus. Note that as described below, the printer apparatus has an operation panel. Therefore, in addition to the recording operation instructions sent from the host apparatus, recording operation instructions can also be designated using this operation panel.

Generally, an image input device such as a scanner or the like that reads images recorded on an original; an input device such as a keyboard and mouse and the like that inputs instructions and data to the host apparatus; and a monitor such as a liquid crystal display that displays data generated using the host apparatus are connected to the host apparatus.

External Configuration

Figure 1:
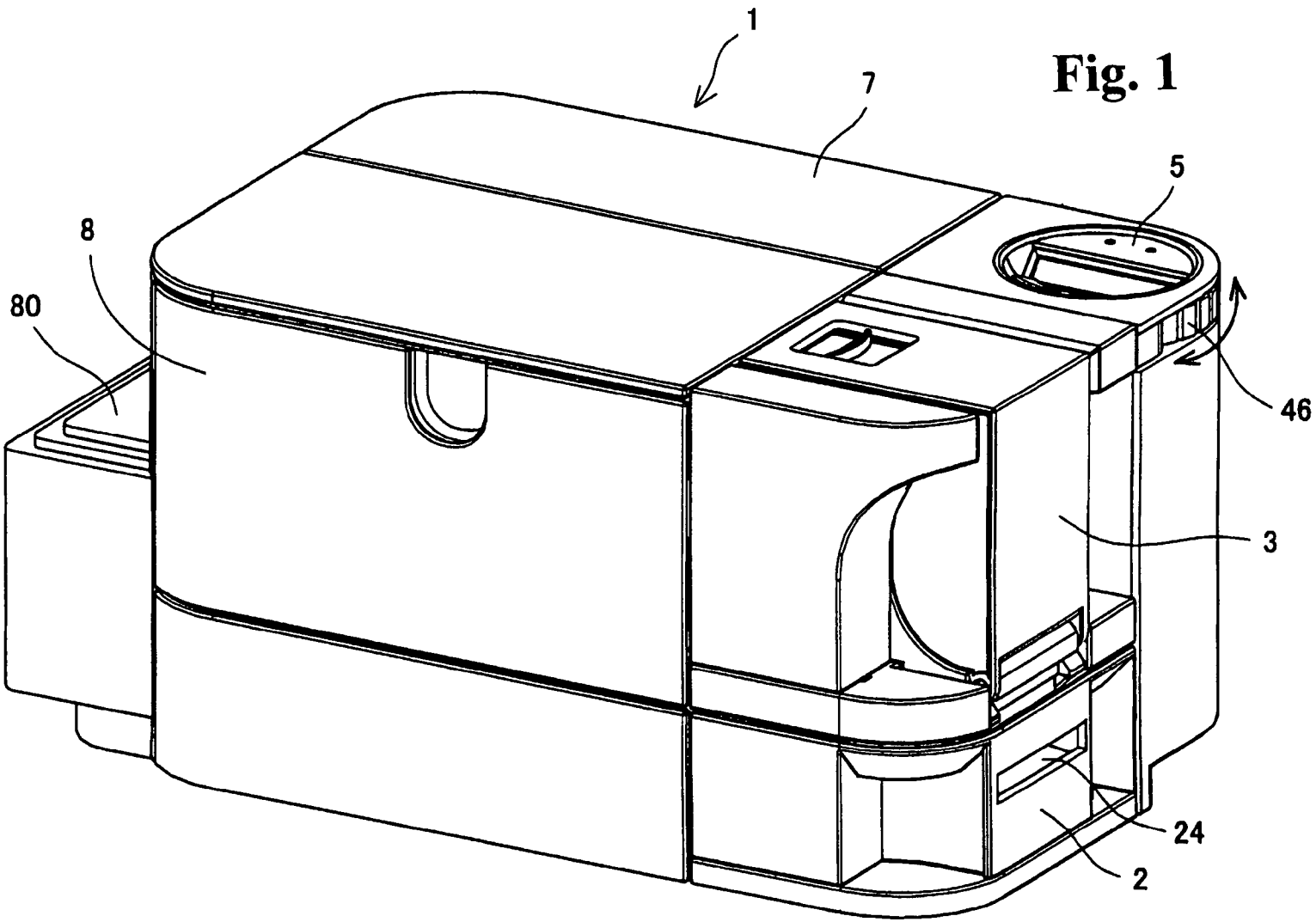
FIG. 1 is an external perspective view of a printing apparatus of an embodiment applied to the present invention.

As shown in FIG. 1, the printer apparatus 1 according to this embodiment has a supply tray 3 detachably mounted to a casing 7 at one side thereof that can store a plurality of blank cards prior to recording in a stacked shape (approximately 100 cards); a discharge tray 2 detachably mounted to the casing 7 at one side thereof that can store recorded cards in an oblique state (approximately 30 cards) below the supply tray 3; and an operation panel 5 that has on an upper portion positioned adjacent to the supply tray 3 at one side of the casing 7, for making various settings such as for the print and magnetic recording processes. Note that the operation panel 5 is provided to rotate in synchronization to the rotation of a dial 46.

A card discharge outlet 24, formed as an opening to discharge recorded cards to outside of the apparatus, is provided at one portion of the discharge tray 2 so that cards can be discharged from the apparatus when the discharge tray 2 is full. Also, an opening cover 8 is provided at one surface of the printer apparatus 1 to allow access to inside the apparatus to detach a cartridge 59 (see FIG. 4) that houses an ink ribbon R used in print recording. The opening cover 8 composes a portion of the casing 7. Note that the opened state of the cover 8 is detected by a cover sensor, not shown. At another side of the casing 7, a magnetic encoder unit 80 is disposed with a portion thereof, the magnetic encoder unit 80 projecting from the casing 7 and opposing the supply tray 3 and the discharge tray 2.

Internal Configuration

Figure 2:
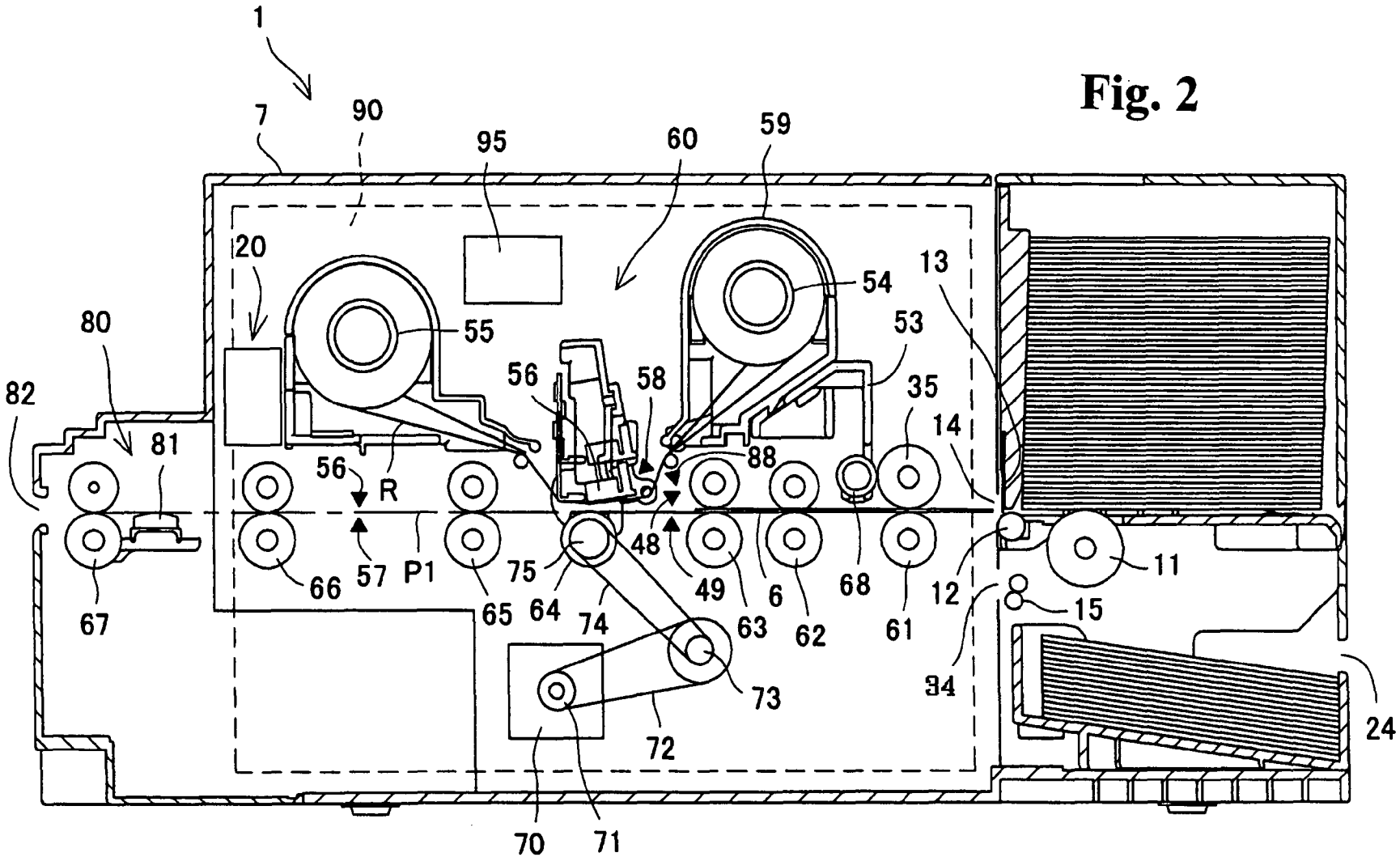
FIG. 2 is a schematic view of a card prior to the recording process being conveyed in a printer apparatus of the embodiment.
Figure 3:
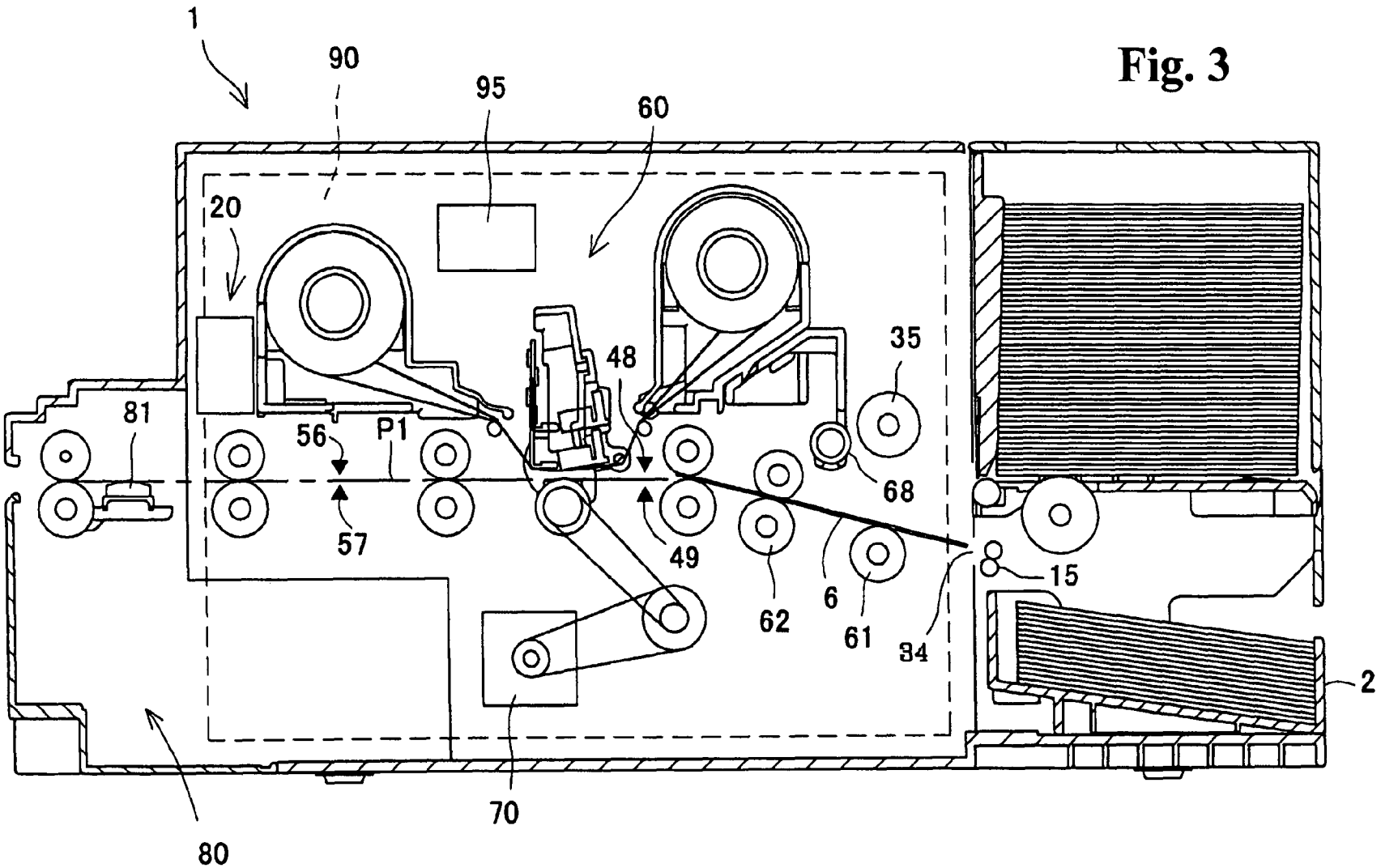
FIG. 3 is a schematic sectional view of the card after the recording process is discharged in a printer apparatus of the embodiment.

The following will now explain each composing element inside the printer apparatus 1 with reference to FIGS. 2 and 3. Note that FIG. 2 shows a blank card prior to being recorded supplied from the supply tray 3 and conveyed toward a printing unit 60. That drawing shows a cleaning roller 35 touching a surface of the conveyed card 6 to clean the printing surface of the card 6. On the other hand, FIG. 3 shows the card 6 recorded at the printing unit 60 and the magnetic encoder unit 80 being conveyed toward the discharge tray 2.

A supply roller 11 that is rotatingly driven by a motor, not shown, is disposed in a side of the apparatus (printing apparatus 1). The printing apparatus 1 has a separating gate 13, composed of a supply roller 12 and a plate-shaped member, to allow only one of the cards 6 to pass into the apparatus when the bottommost (lowest level card 6) card 6 stacked in the supply tray 3 is fed into the apparatus by the supply roller 11. The supplied card 6 passes the supply roller 12 and the separating gate 13 and is guided to a card supply opening 14 provided at one side of the casing 7 to link with the supply tray 3.

On the other hand, recorded cards 6, discharged from the discharge outlet 34 formed below the card supply opening 14 at one side of the casing 7, are sequentially discharged and stored in the discharge tray 2 by a discharge roller 15 (see FIG. 3).

The discharge roller 15 is fastened to the printer apparatus 1 side. A motor, not shown, that rotatingly drives the supply roller 11, rotatingly drives this discharge roller 15, but in the case where the supply roller 11 is rotating in a direction to supply a card 6 from the supply tray 3, the reverse drive of the motor, not shown, rotatingly drives to discharge the card 6 to the discharge tray 2.

Specifically, the supply roller 11 and discharge roller 15 are rotated by the forward and reverse drives of the motor (not shown), but because a one-way clutch (not shown) is installed in the supply roller 11, it is possible to rotate only in the card supply direction. In this embodiment, the supply operation for cards 6 that have not been recorded and the discharge operation for recorded cards 6 do not occur at the same time, so the rotation for discharging the card 6 by the discharge roller 15 and the rotation in a direction opposite thereto are not hindered.

The card 6 supplied from the card supply opening 14 is conveyed along the substantially horizontal path P1 and sequentially handed over to conveyance rollers 61, 62 and 63 having driving force transmitted from the conveyance drive motor 70 which is described below. Note that the conveyance rollers 62 and 63 are composed of a pair of rollers having a drive roller and a follower roller. (Hereinafter, unless an explanation is provided, the explanation will focus only on the drive roller, omitting an explanation of the follower roller of the pair of rollers.)

At an opposite side of the conveyance roller 61, the cleaning roller 35 is positioned to advance to and retreat from the card conveyance path P1 to oppose the conveyance roller 61. When the cleaning roller 35 is advanced to above the card conveyance path P1 to touch the conveying card 6 (see the state shown in FIG. 2), the card 6 is gripped between cleaning roller 35 and the conveyance roller 61 that has drive force, thereby removing foreign matter such as dust and dirt from the print surface to be printed at the printing unit 60, when those rollers rotate.

When the cleaning roller 35 advances above the card conveyance path P1 where the roller operates, the cleaning roller 35 is positioned to touch the surface of a roller-shaped cleaner 68 positioned at a predetermined position away from the card conveyance path P1 adjacent to the cleaning roller 35. The roller-shaped cleaner 68 is rotatably mounted to a support member 53 detachably installed at a predetermined position of a cartridge 59.

At a downstream side of the conveyance roller 63 in the direction of card conveyance, the printing unit 60 is established that prints and records predetermined characters and images to a surface of the card 6 cleaned by the cleaning roller 35.

The printing unit 60 of this embodiment adopts the configuration of a thermal transfer type printer. This unit has a thermal head 56 to advance and retreat with regard to a platen roller 64 established at a printing position on the card conveyance path P1. The ink ribbon R, having a plurality of colors of an ink layer Y (yellow), M (magenta), C (cyan), Bk (black) and the like, and being repeated sequentially on its surface, interposes the platen roller 64 and the thermal head 56.

Cartridge

Figure 6:
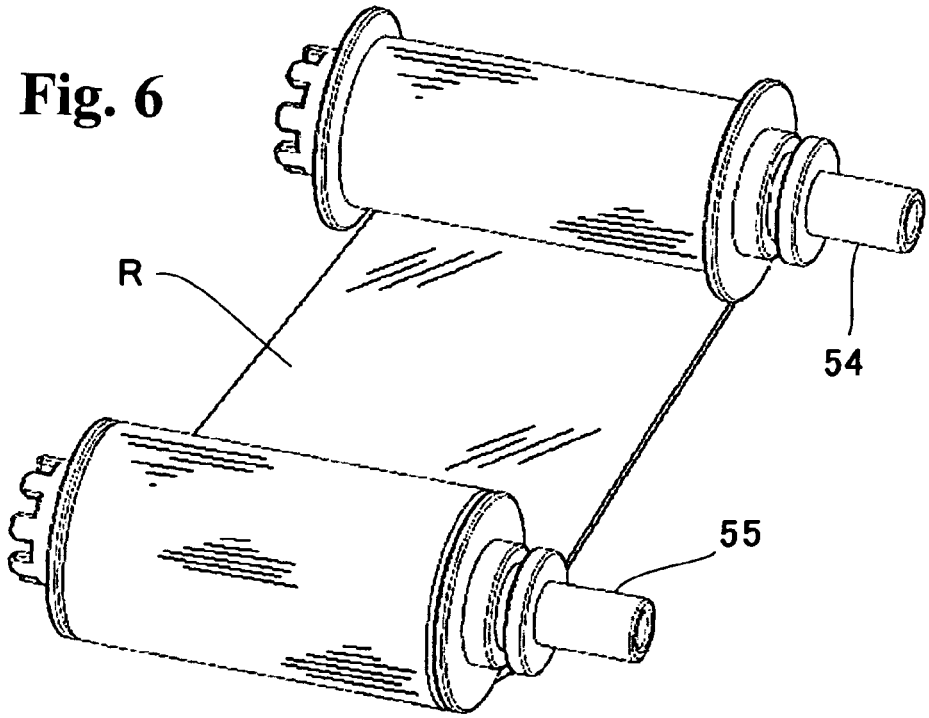
FIG. 6 is an external perspective view of an ink ribbon housed in the cartridge.

The following will now explain the cartridge 59 with reference to FIGS. 4 to 6. As shown in FIG. 6, the cartridge 59 is composed by housing an ink ribbon unit having a supply spool 54 that supplies the ink ribbon R with a plurality of colors, namely the ink layers of Y (yellow), M (magenta), C (cyan) and Bk (black) repeated sequentially on a surface thereof; and a take-up spool 55 that retrieves the ink ribbon R.

As shown in FIG. 4, a substantially flat, plate-shaped stopper 4 integrated to the cartridge 59 by an insert molding method to maintain a predetermined strength, and a substantially sectionally L-shaped guide 5 the long side of the L-shape disposed obliquely with regard to the stopper 4, project at a corner of the take-up spool 55 of the cartridge 59. The stopper 4 is disposed at the front, and the guide 5 is disposed at the backside along the direction of insertion of the cartridge 59. The functions of the stopper 4 and guide 5 will be explained below.

As shown in FIG. 5, a ROM substrate 27 mounted with a non-volatile EEPROM is fastened to a backside of the take-up spool 55 of the cartridge 59. The cartridge 59 is configured to be detachable to the main apparatus. Note that the cartridge 59 has a male connector, not shown, to connect the main apparatus and the EEPROM; by mounting the cartridge 59 to the main apparatus, the male connector of the cartridge 59 connects to the female connector on the main apparatus.

Cartridge Detection Mechanism

As shown in FIG. 2, a cartridge detection mechanism 20 that detects the cartridge 59 (an installation thereof) is disposed on the take-up spool 55 side of the cartridge 59 installed in the main apparatus.

Figure 7:
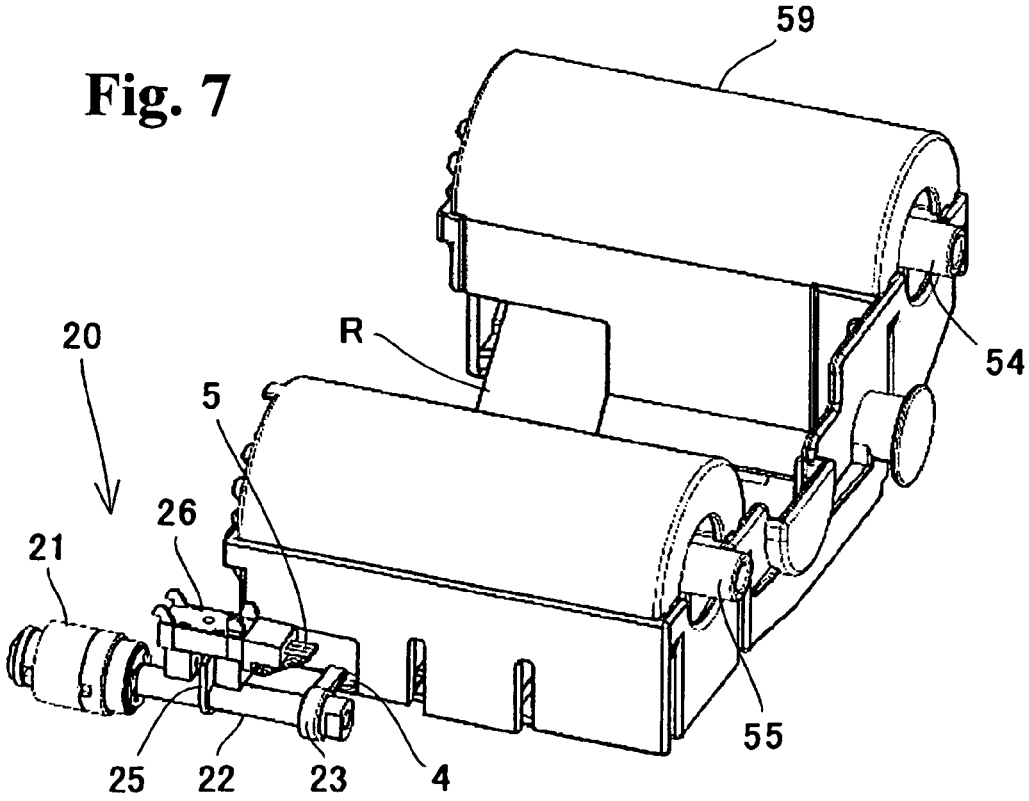
FIG. 7 is an external perspective view of a cartridge detection mechanism in the printer apparatus of the embodiment.

As shown in FIG. 7, the cartridge detection mechanism 20 is composed of a transmissive type detection sensor 26 composed of a light emitting element and a light receiving element; a drive link 21 that receives the supply of rotational drive force of a motor (not shown), that rotatingly drives the supply spool 54 and take-up spool 55 described below; a rotatable shaft 22 connected to the drive link 21; a target member 25 which is fastened to the shaft 22 and intercepts light of the detection sensor 26; and a locking member 23 which is fastened to the shaft 22 and stops at the stopper 4 on the cartridge 59. The target member 25 and locking member 23 are disposed to project from the shaft 22, and a phase difference of 90° is provided for the projecting directions of both members in this embodiment. Note that the drive link 21 has a spring clutch that allows rotation of the shaft 22 (the target member 25 and locking member 23) only in the clockwise direction.

As shown in FIG. 2, when the printing unit 60 conducts thermally transfer-record for information such as characters or images and the like to the card 6 moving along the card conveyance path P1, the ink ribbon R is supplied from the supply spool 54 and conveyed at the same speed as the conveyance speed of the card 6 while touching substantially the entire surface to the leading end of the thermal head 56 and is retrieved by a take-up spool 55. The supply spool 54 and the take-up spool 55 are rotatingly driven by a motor, not shown. Also, by installing the cartridge 59 to the main apparatus, an encoder plate, (not shown) that rotates as one body with the rotation of the supply spool 54 and take-up spool 55, is linked to the supply spool 54 and take-up spool 55. The each encoder plate is disposed in the casing 7.

The ink ribbon R interposes between the thermal head 56 and the card 6 top surface. The ink ribbon R presses against the thermal head 56 while heating elements in the thermal head 51 are selectively operated to print predetermined characters and images to the card 6. A plurality of guide shafts, and a transmissive type sensor composed of a light-emitting element 58 and a light-receiving element 88 that detects the ink layer Bk (black) to align the top of a predetermined ink layer (in this embodiment, the ink layer Y) are provided in the ink ribbon R conveyance path.

Replacing Mechanism

The replacing mechanism 200 arranged in the printing unit 60 that allows replacement of the cartridge 59 with one operation, and shifting the thermal head 56 to a replaceable state will now be described with reference to FIGS. 14 to 23.

As shown in FIGS. 14 to 23, the replacing mechanism 200 is mainly composed of a head holder 221 that holds the thermal head 56; a head holder moving member 222 that moves the head holder 221 to the platen roller 64; a head holder pressing unit 223 connected to the head holder moving member 222 and presses the head holder 221 to the platen roller 64; a ribbon take-up unit 237 that retrieves the slack in the ink ribbon R; a shaft 230 connected to the head holder moving member 222 and ribbon take-up unit 237 disposed substantially parallel to the platen roller 64 between the ribbon take-up spool 55 and head holder 221; a manual lever 201 provided at one side of the shaft 230 (bottom side of FIG. 14) that rotates the shaft 230; and a cartridge lock 201A (see FIG. 14) integrated with the lever 201 and provided at one side of the shaft 230, that touches a portion of the cartridge 59 to lock the cartridge 59.

Head Holder

Figure 16:
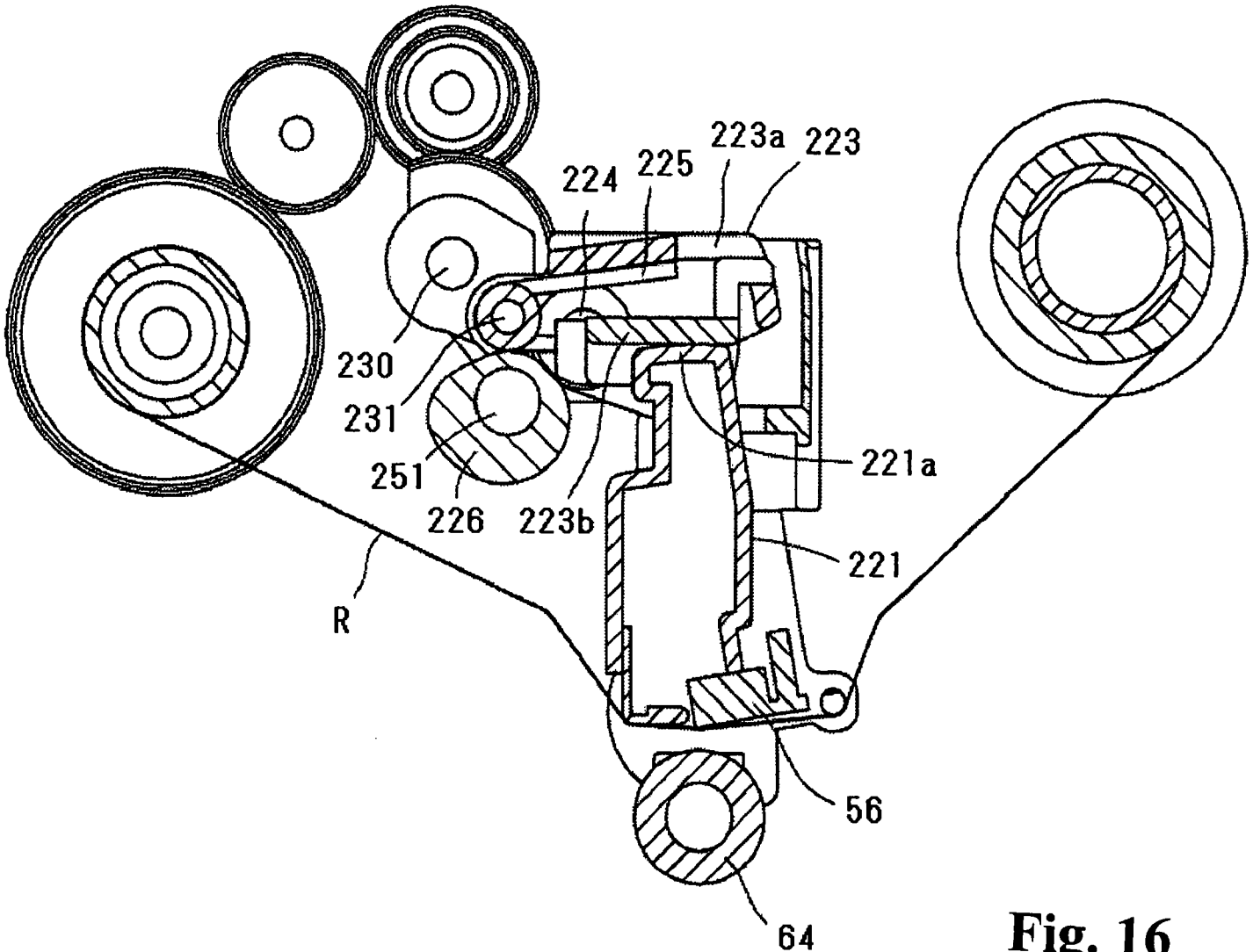
FIG. 16 is a sectional view of a replacement mechanism of the printer apparatus showing a head holder pressing unit pressing a pressing unit of the head holder in the direction of the platen roller.
Figure 19:
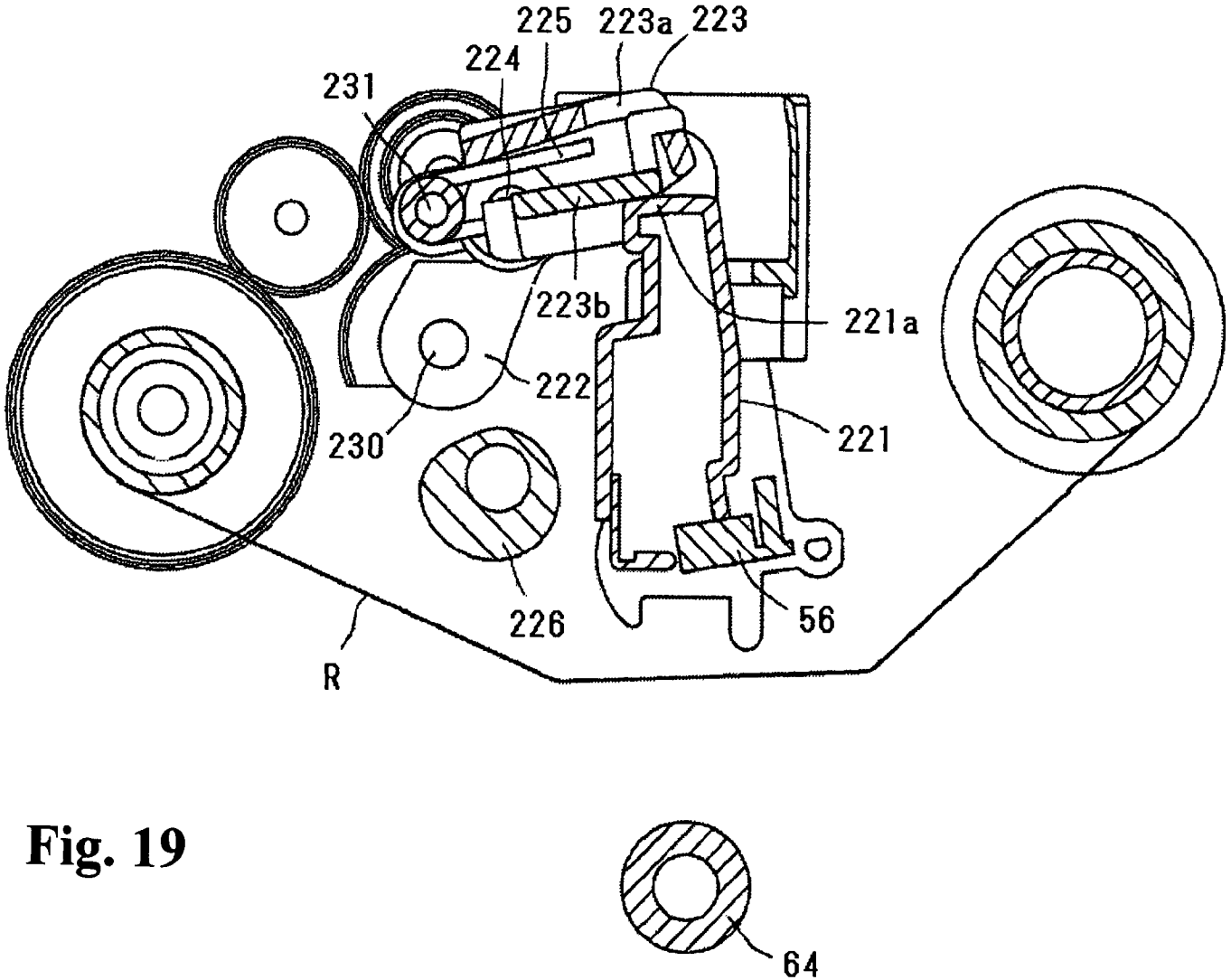
FIG. 19 is a sectional view of the replacement mechanism of the printer apparatus showing the head holder pressing unit releasing pressure on the head holder.

As shown in FIGS. 16 and 19, the inside of the head holder 221 is hollow and substantially box-shaped; and holds the thermal head 56 to expose the heating elements disposed at a leading end of the thermal head 56. Note that FIG. 16 shows the head holder pressing unit 223, pressing a pressed unit 221*a* that configures a top of the head holder 221 in a direction where the platen roller 64, is disposed.

Figure 14:
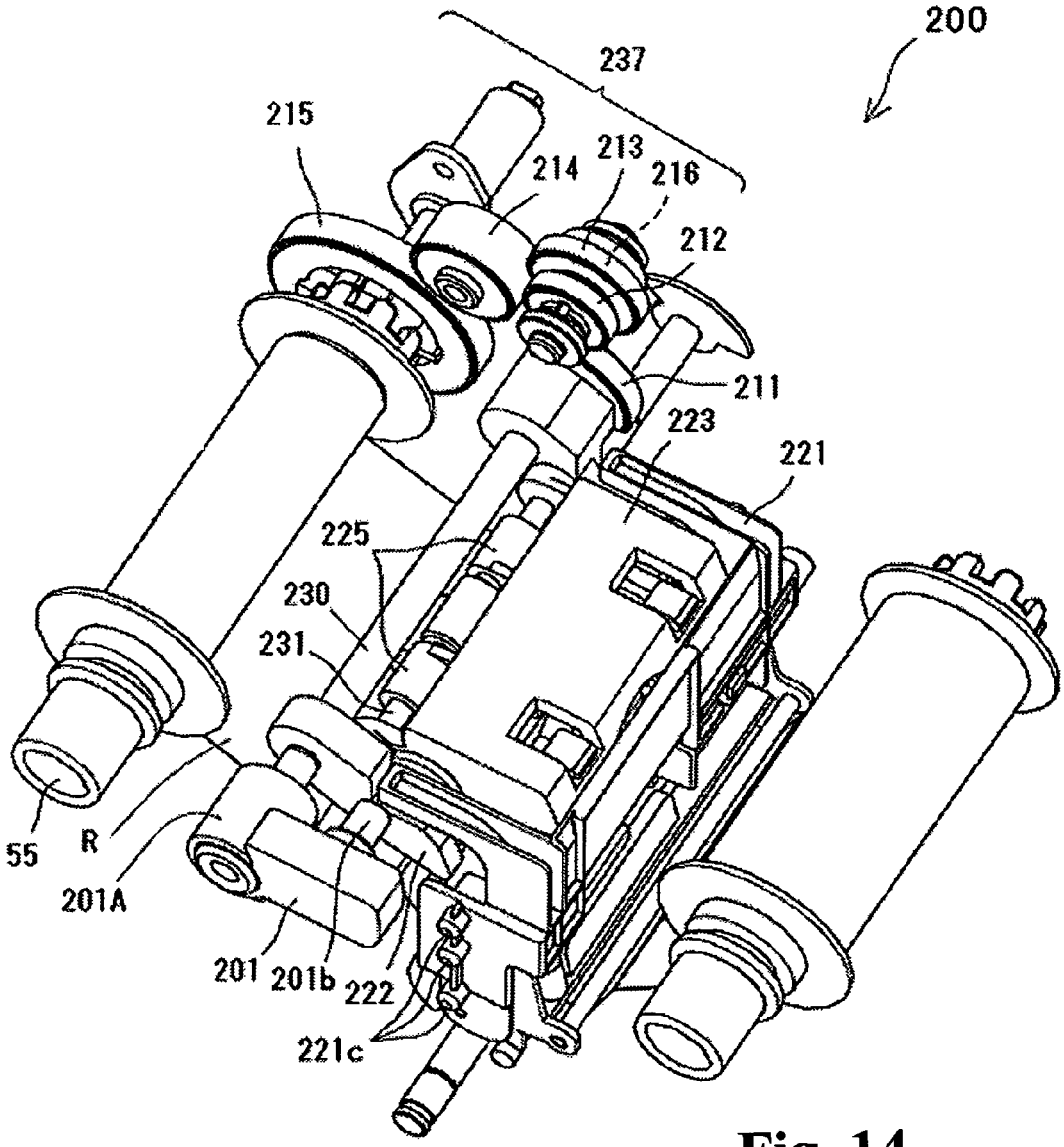
FIG. 14 is a perspective view of a replacement mechanism of the printer apparatus showing the cartridge installed in the apparatus in a locked state.
Figure 17:
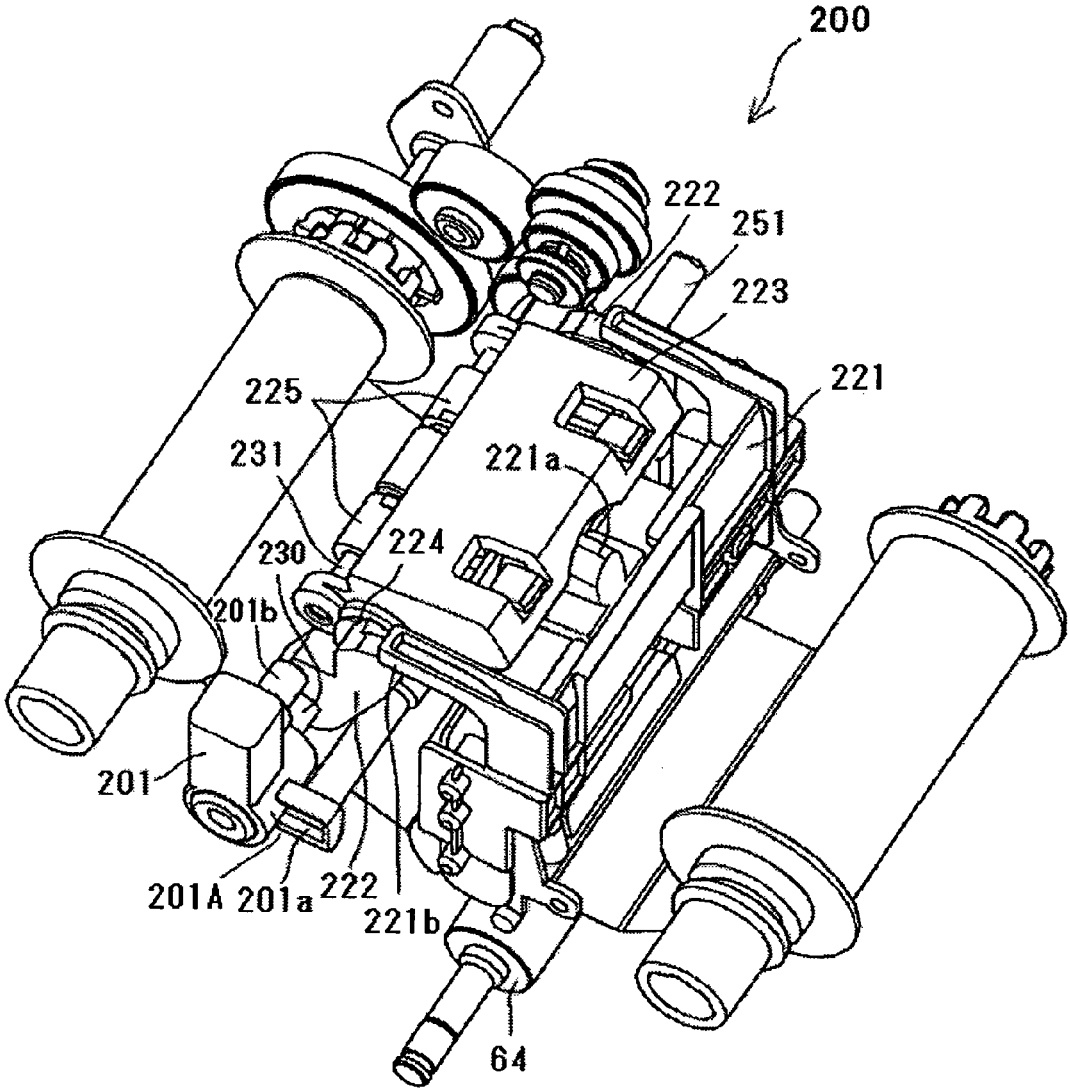
FIG. 17 is a perspective view of the replacement mechanism of the printer apparatus showing the cartridge installed in the apparatus in an unlocked state.
Figure 20:
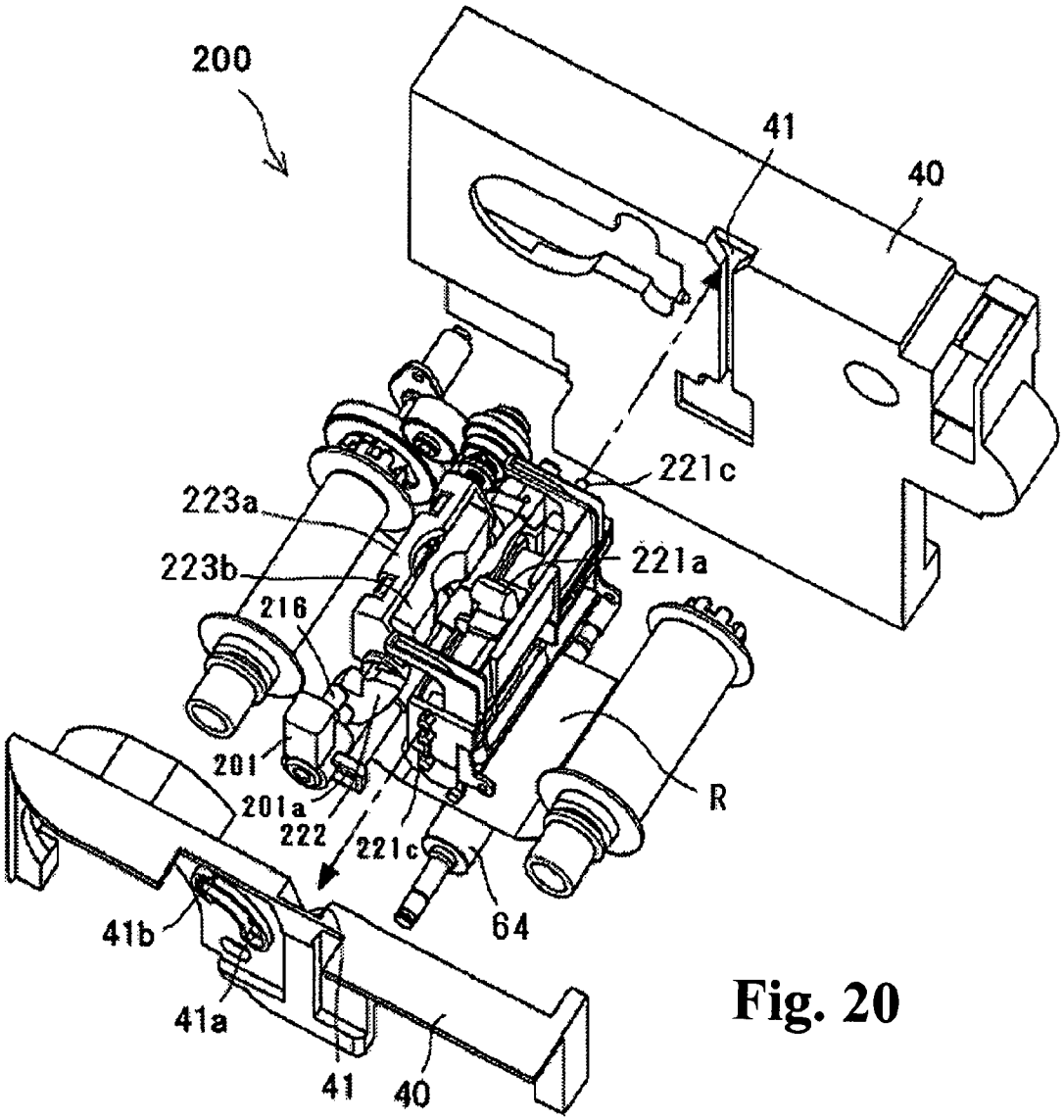
FIG. 20 is a perspective view of the replacement mechanism of the printer apparatus showing a relationship between the replacement mechanism and frame.
Figure 21:
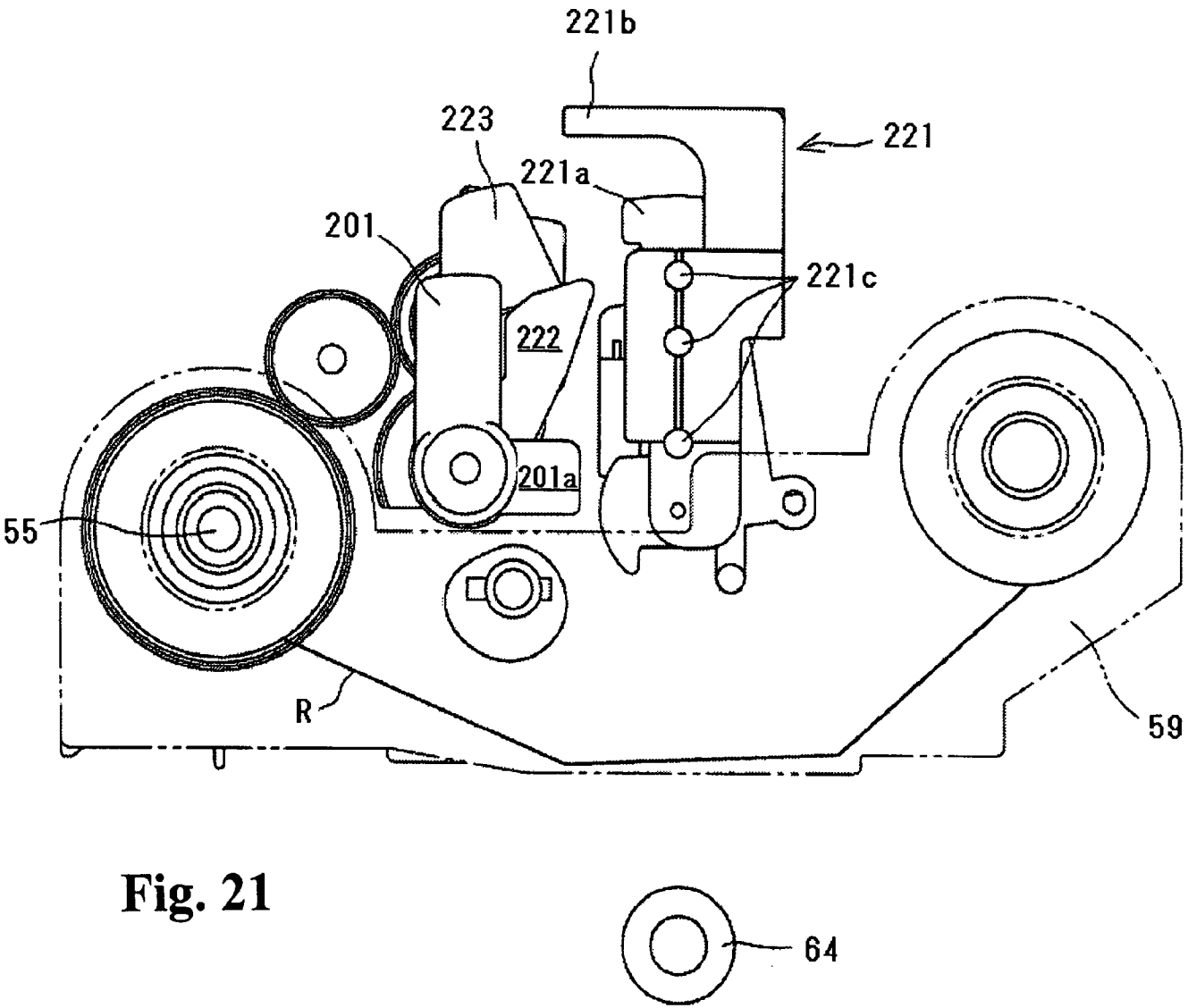
FIG. 21 is a front elevation view of the replacement mechanism of the printer apparatus showing a position of the head holder when replacing the thermal head.

As shown in FIGS. 14 and 17, a plurality of convex portions 221*c* are provided at both side ends of the head holder 221; and as shown in FIG. 20, the convex portions 221*c* can move in up and down directions along a channel 41 formed in the frame 40 fastened to the casing 7 inside the apparatus. Note that, as shown in FIG. 20, to make the channel 41 easier to see, the frame 40 has been conveniently drawn separated from the channel 41, but the convex portions 221 and the channel 41 are actually adjacent. As shown in FIGS. 17 and 18, the head holder 221 has a substantially L-shaped touching portion 221*b* that touches the head holder moving member 222 at the top on both sides.

Head Holder Pressing Unit

As shown in FIGS. 14 and 16, the head holder pressing unit 223 is composed of a hollow, substantially box-shaped chassis; a shaft 231 disposed substantially parallel to a shaft 230 outside of the chassis; coiled springs 225 of which the shaft 231 penetrates the coil portion; and a joint 224 disposed in both sidewalls of the chassis that joins to the head holder moving member 222.

As shown in FIG. 16, a torsion coil spring is used for the coiled spring 225, and both ends of the coiled spring 225 are stopped by the top plate 223*a* that composes a top of the chassis, and the bottom plate 223*b* that composes the bottom of the chassis. For this reason, the chassis has a two-tiered structure of the top plate 223*a* and the bottom plate 223*b*.

The head holder pressing unit 223 rotates using the joint 224 as its axis. A cam 226 fastened to the shaft 251 arranged substantially parallel to the shaft 231 touches the shaft 231. When the cam 226 rotates, it pushes the shaft 231 upward, and the pressed unit 221*a* of the head holder 221 is pressed to a direction where the platen roller 64 is disposed. With the rotation of the cam 226, a printing position where images are formed on the card 6, and a print idling position for conveying the card 6 are created. Note that the cam 226 (shaft 251) is rotatingly driven by a motor (not shown) described above to drive the ribbon supply spool 54 and the ribbon take-up spool 55 via a drive transmission mechanism (not shown).

Head Holder Moving Unit

As shown in FIGS. 17 and 18, the head holder moving member 222 mates with the shaft 230 at both sides to sandwich the head holder pressing unit 223. The head holder moving member 222 is integrally formed with the base fastened to the shaft 230, and a projection that projects from the base. The joint 224 of the head holder pressing unit 223 is rotatably joined to the projection of the head holder moving member 222. A leading end 222*a* of the projection of the head holder moving member 222 forms an acute angle, and with the rotation of the shaft 230, it is possible to lift the head holder 221 away (retreated) from the platen roller 64 by touching the touching portion 221*b* of the head holder 221.

Lever

As shown in FIGS. 14 and 17, a cylindrical block 201A is mated at one side end (bottom of FIG. 6) of the shaft 230, and a square pillar-shaped lever 201, and a sectionally, substantially U-shaped cartridge lock 201*a* are integrally formed on the block 201A to project having a 90° angle (phase) difference. A pin-shaped projection 201*b* is disposed on the lever 201 projecting to the inside (the top sides of FIGS. 14 and 17).

Figure 15:
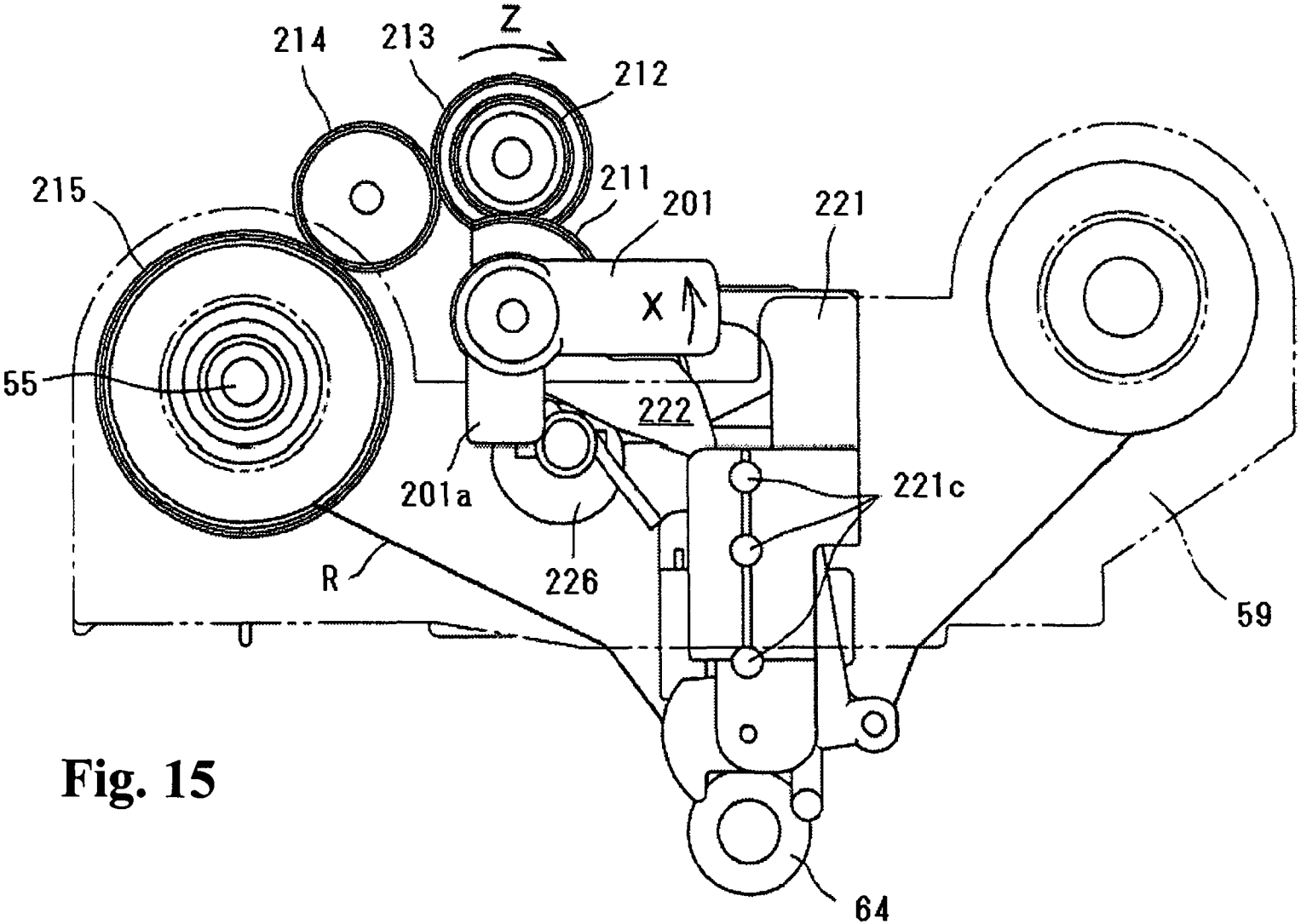
FIG. 15 is a front elevation view of the replacement mechanism of the printer apparatus showing the cartridge installed in the apparatus in a locked state.
Figure 22:
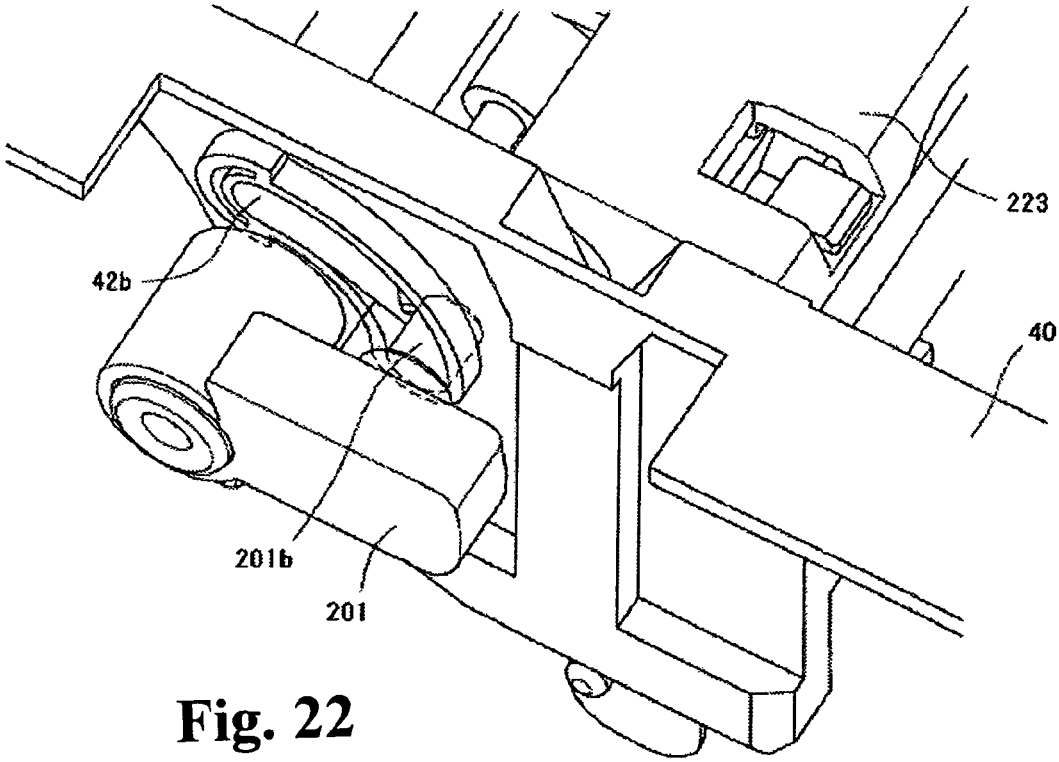
FIG. 22 is a perspective view of a channel in the frame showing a projection mating with the channel at a locking position.
Figure 23:
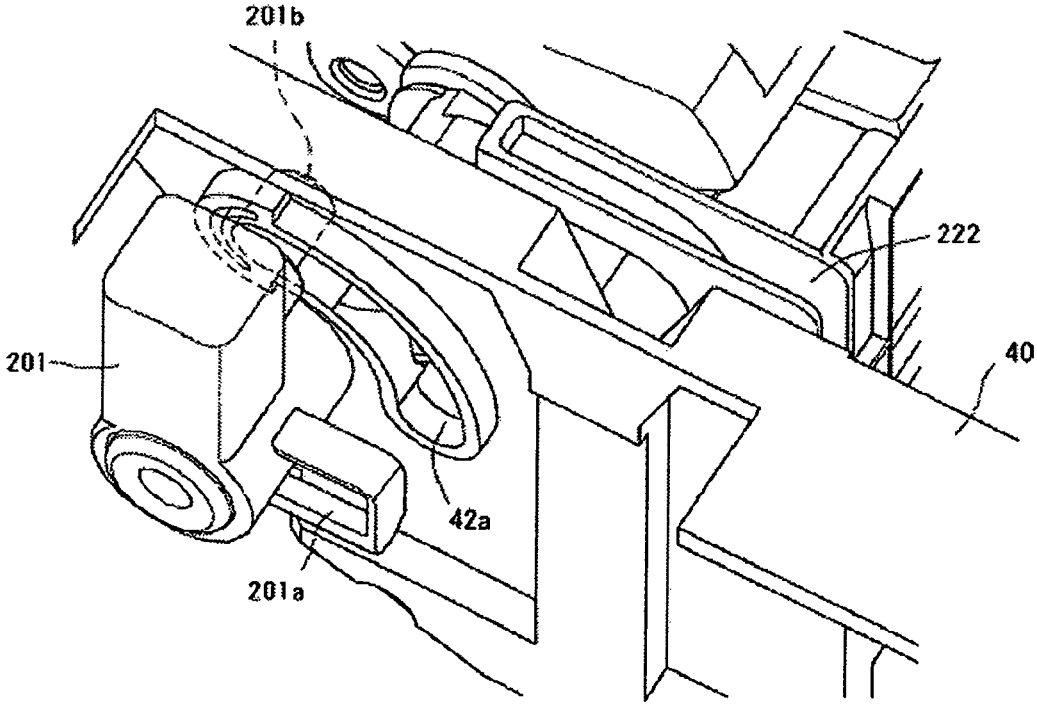
FIG. 23 is a perspective view of a channel in the frame showing the projection mating with the channel at a releasing position.

FIG. 15 shows the cartridge 59 fastened (locked) at its installed state in the apparatus with the cartridge lock 201*a* touching the cartridge 59. In this state, as shown in FIG. 22, the projection 201*b* mates with the concave portion 42*a* that has a moderate channel shape formed in the frame 40, and is fastened at a locking position. Note that when an operator turns the lever 201, it is first pulled toward the front (bottom side of FIG. 14) once, then turned either in the direction of the arrow X in FIG. 15 (to unlock), or in the opposite direction in the direction of the arrow Y in FIG. 18 (to lock).

Ribbon Take-Up Unit

A fan-shaped gear 211 is mated to another end (top side of FIG. 14) of the shaft 230. The fan-shaped gear 211 meshes with the intermediate gear 212. A gear 213 is mated onto the same shaft as the intermediate gear, and a one-way clutch 216 is provided on the gear 213. The one-way clutch 216 transmits drive force only in the direction of the Z in FIG. 15. The gear 213 meshes with the gear 214, and the gear 214 meshes with the gear 215 connected by meshing with the ribbon take-up spool 55 when the cartridge 59 is installed. The ribbon take-up unit 237 is composed of these elements.

A transmissive type sensor (hereinafter referred to as a first card detection sensor), composed of a light-emitting element 48 and a light-receiving element 49 that detects a leading edge and a trailing edge of the card 6 in the direction of conveyance conveyed along the conveyance path P1, is disposed in an upstream side (the conveyance roller 63 side) of the thermal head 56 in the direction of conveyance of the card.

A conveyance drive motor 70, composed of a stepping motor capable of both forward and reverse drives, is disposed below the printing unit 60 to rotatingly drive the series of conveyance rollers 61, 62 and 63 and the platen roller 64. A pulley 71 mounted on the rotating shaft of the conveyance drive motor 70 transmits the rotational driving force of the conveyance drive motor 70 to the pulley 73 by the belt 72, and rotational driving force is transmitted to the platen roller 64 by the belt 74 one end thereof trained on the pulley 73, via the pulley 75 disposed on the rotating shaft of the platen roller 64.

A plurality of gears (not shown) is disposed on the rotating shaft of the platen roller 64 and the conveyance rollers 61, 62 and 63, and between each of the rollers. Rotational driving force transmitted to the platen roller 64 is transmitted to each of the conveyance rollers 61, 62 and 63 via the plurality of gears.

A nip roller 65, which nips the card 6 when print recording thereto by the printing unit 60, has a function to convey the card 6 to a downstream side of the platen roller 64 in the conveyance direction (the take-up spool 55 side). This roller is disposed along the conveyance path P1. Further, a feed roller 66 is disposed to convey the card 6 along the same conveyance path P1 at the downstream of this nip roller 45 in the direction of card conveyance. A transmissive type sensor (hereinafter referred to as a second card detection sensor), composed of a light-emitting element 56 and a light-receiving element 57 that detects a leading edge of the card C in the direction of conveyance conveyed along the conveyance path P1, is disposed in substantially the center of the nip roller 65 and the feed roller 66.

Gears (not shown) are mounted on the nip roller 65 and the feed roller 66. Also, a plurality of gears is disposed between the platen roller 64 and nip roller 65, and the nip roller 65 and the feed roller 66. The plurality of gears (not shown) mutually mesh to transmit the rotational drive force from the conveyance drive motor 70 to the nip roller 66 and the feed roller 66 by branching from the gear disposed on the rotating shaft of the platen roller 64 via drive force transmission mechanism including the pulleys, belts and plurality of gears (not shown).

The magnetic encoder unit 80 is disposed adjacent to the feed roller 66 downstream of the printing unit 60 in the direction of card conveyance. A reciprocating (self-propelled) magnetic head 81 that scans along the conveyance path P1 is disposed in the magnetic encoder unit 80 to magnetically record to the magnetic strip of the card 6 held in a stopped state by the nip roller 65 and the feed roller 66.

A card discharge outlet 82, formed as an opening to discharge the card 6 conveyed along the conveyance path P1 to outside of the apparatus, is provided at one portion of the magnetic encoder unit 80. Specifically, this card conveyance outlet 82 is provided on an extended line of the conveyance path P1 at the other side of the casing 7 opposite to the card supply opening 14. Therefore, it is possible to convey in a cleaning card to clean the plurality of rollers disposed in the card conveyance path P1 and outside the apparatus via the card conveyance outlet 82 after cleaning the rollers.

A conveyance out roller 67 that conveys the card 6 toward the card conveyance outlet 82 and further conveys from the card conveyance outlet 82 is disposed in the magnetic encoder unit 80. There is no source of drive force provided in the magnetic encoder unit 80 to rotatingly drive the conveyance out roller 67, but a plurality of gears, not shown, is provided and linked between the conveyance out roller 67 and feed roller 66 to transmit rotational driving force transmitted to the feed roller to the conveyance out roller 67.

Therefore, the printer apparatus 1 has a configuration that provides the card supply opening 14, the printing unit 60 and the magnetic encoder unit 80 along a substantially horizontal card conveyance path P1 connected from the supply unit 3.

As is clearly shown in the drawing, the magnetic encoder unit 80 has a unit shape portion thereof fit into the apparatus. The conveyance drive motor 70 is disposed under the printing unit 60 and between the magnetic encoder unit 80 and the moving mechanism 110, explained below, (see FIG. 9) that moves the conveyance rollers 61 and 62 to the first and second positions.

Figure 9:
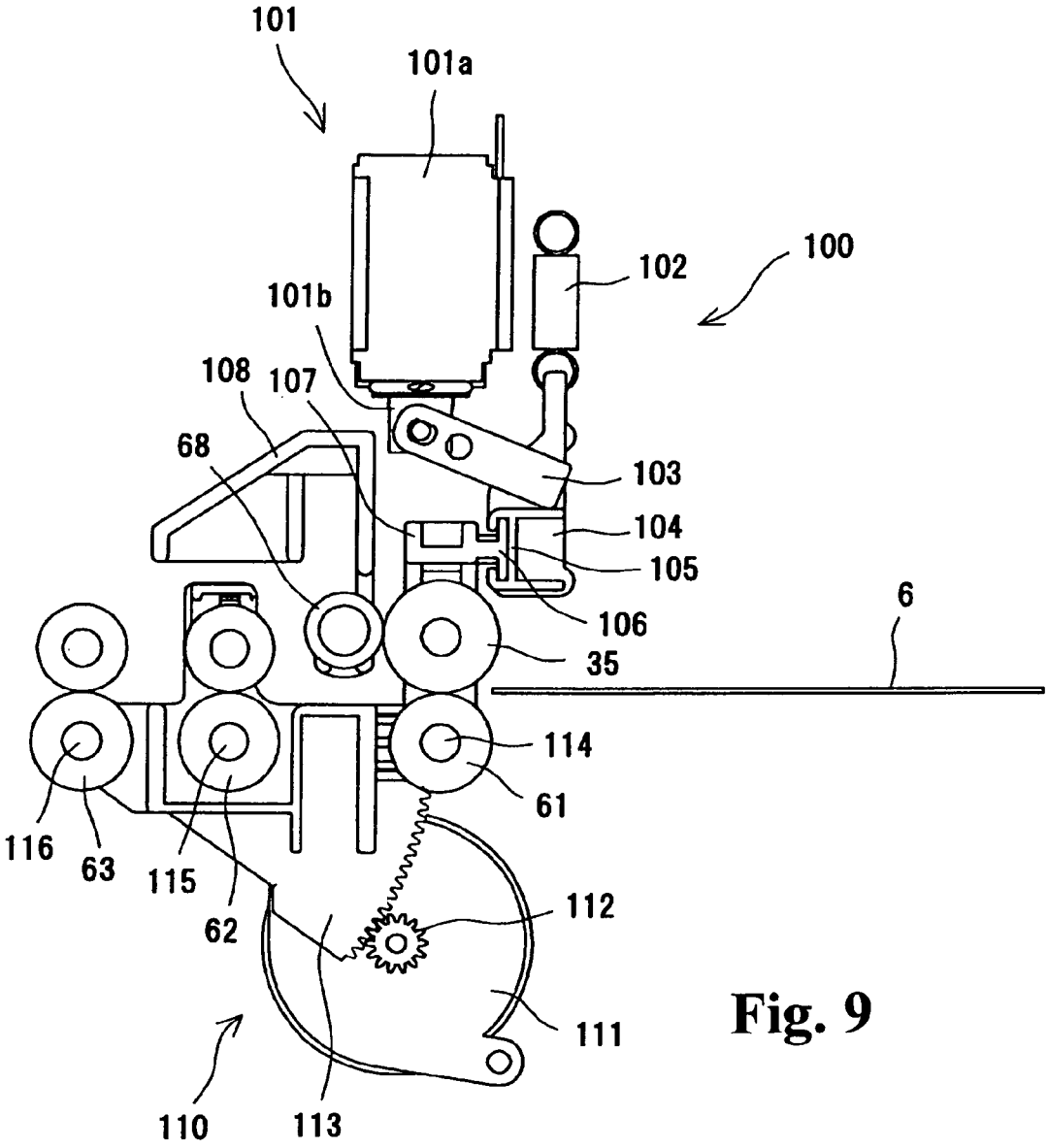
FIG. 9 is a partially expanded view of a moving mechanism and card cleaning mechanism in the printer apparatus of the embodiment.

The following will now explain the card cleaning mechanism 100 and the moving mechanism 110 with reference to FIG. 9. Note that FIG. 9 shows the card 6 received from the card supply opening 14 and the state just before the card 6 is nipped by the cleaning roller 35 and the conveyance roller 61.

The card cleaning mechanism 100 has an actuator 101 composed of a solenoid 101*a* to enable the cleaning roller 35 to move between an operating position where it touches the card 6 (surface contact) and the roller-shaped cleaner 68 by advancing into the card conveyance path P1, and a retreated position that is a home position separated from the conveyance path P1, and a plunger 101*b* that advances and retreats by the drive switch (ON/OFF) of the solenoid 101*a*.

A lever member 103 with one end rotatably mounted to an end of the plunger 101*b* is provided, and an engaging member 104 that engages the other end of the lever member 103 is provided. One end of the engaging member 104 is hooked to a tension spring 102 fastened to a predetermined position inside the apparatus, and urging force from the tension spring 102 constantly urges the engaging member 104 upward.

The card cleaning mechanism 100 has a holder 107 that holds the cleaning roller 35, and has an integrated configuration where a convex portion 106 formed on a portion of the holder 107 is fit into a concave portion 105 formed on a portion of the engaging member 104. The card cleaning mechanism 100 has a configuration that includes a roller-shaped cleaner 68 rotatably mounted to a support member 108 detachably installed at a predetermined position of a cartridge 59 that houses an ink ribbon R as a portion of the printing unit 60.

Note that when the solenoid 101*a* of the drive unit 101 is driven (drive ON), the lever member 103 pushes the engaging member 104 downward thereby indirectly pushing the holder 107 that holds the cleaning roller 35 downward where the cleaning roller 35 is positioned at the operating position.

As shown in FIG. 9, the moving mechanism 110 has a stepping motor 111 capable of forward and reverse drives, a motor gear 112 mounted on the rotating shaft of the stepping motor 111, and a geared bracket 113 that has a geared portion that meshes with the motor gear 112. Roller shafts 114, 115, and 116 that support the conveyance rollers 61, 62 and 63 are held by the geared bracket 113.

Because the geared bracket 113 is established to rotate around the roller shaft 116 of the conveyance rollers 63, the moving mechanism 110 allows the conveyance rollers 61 and 62 to move between the first position (a position where the conveyance rollers 61 and 62 form a substantially level card conveyance path; a home position, see FIG. 2) and the second position (a position where the conveyance rollers 61 and 62 form an oblique conveyance path; see FIG. 3).

As shown in FIG. 2, the printer apparatus 1 has a control unit 95 that controls overall operations of the printer apparatus 1 and a power unit 90 that converts commercial alternating current into direct current to drive and operate each of the mechanisms and control unit.

The control unit 95 comprises the microcomputer (hereinafter referred to as the microcomputer) that controls the overall processes of the printer apparatus 1. The microcomputer is composed of a CPU that operates at a high-speed clock as a central processing unit, a ROM written with basic control operations (programs and program data) of the printer apparatus 1, and RAM as the CPU work area, and internal busses connecting these.

External busses are connected to the microcomputer. An interface, not shown, that communicates with the host apparatus, and a buffer memory that temporarily stores print recording data to be printed on the card 6, and magnetic data that should be magnetically recorded in the magnetic strip on the card 6 are connected to the external busses.

A sensor control unit that controls signals from each sensor; an actuator control unit that controls the motor driver and the like that sends the drive pulse of each motor and drive power; a thermal head control unit that controls the thermal energy of the thermal head 56; an operation display unit that controls the operation panel 5; and the magnetic encoder unit 80 are connected to the external busses.

The sensor control unit is connected to first and second sensors, a detection sensor 26 and other sensors (not shown) such as an empty sensor. The actuator control unit is connected to the conveyance drive motor 70, the stepping motor 111, and another motor (not shown), and the actuator. The thermal head control unit is connected to the thermal head 56, and the operation display control unit is connected to the operation panel 5.

Note that the power unit 90 supplies operating and drive power to the control unit 95, the thermal head 56, the operating panel 5 and the magnetic encoder unit 80.

The following will now explain operations of the printer apparatus 100 to install and uninstall the cartridge 59 (hereinafter the operation to uninstall the cartridge 59 will be referred to as the uninstall operation; and the operation to install the cartridge 59 will be referred to as the install operation) mainly using the replacement mechanism 200, and the operations of the overall (hereinafter referred to as overall operations) apparatus of the CPU (hereinafter simply referred to as the CPU) of the microcomputer of the control unit 85.

Uninstall Operations

When replacing (uninstalling) a cartridge 59, the operator opens the cover 8, pulls the lever 201 and then turns it in the direction of the arrow X in FIG. 15. When the lever 201 is turned in the direction of the arrow X, the lock of the cartridge 59 by the cartridge lock 201*a* is released, freeing the cartridge 59 to allow it to be pulled out. In other words, the states shown in FIGS. 14 and 15, or the locked state, are shifted to the states shown in FIGS. 17 and 18, or the unlocked state.

By the operator turning the lever 201 in the direction of the arrow X in FIG. 15, the shaft 230 is rotated, and the head holder moving member 222 established on the shaft 230 and the joint 224 of the head holder pressing unit 223 joined to head holder moving member 222 move in the direction of the arrow X. This causes the pressure to the head holder 221 by the head holder pressing unit 223 to be freed and the head holder 221 to enter the state shown in FIG. 19.

Also, by the operator turning the lever 201 in the direction of the arrow X in FIG. 15, the shaft 230 is rotated, and the leading end 222*a* of the head holder moving member 222 also moves in the direction of the arrow X in FIG. 15. The leading end 222*a* lifts up the head holder 221 to retreat from the platen roller 64 according to the movement of the lever 201 by touching the touching portion 221*b* of the head holder 221. At this time, the convex portions 221*c* of the head holder 221 move along the channel 41 of the frame 40.

Also, by the operator turning the lever 201 in the direction of the arrow X in FIG. 15, the shaft 230 and the fan-shaped gear 211 are rotated, thereby rotating the intermediate gear 212 that is meshed to the fan-shaped gear 211. The intermediate gear 212 is connected to the gear 213. The one-way clutch 216 established on the gear 213 transmits drive force only in the direction of the arrow Z in FIG. 15. The gear 213 meshes with the gear 214; and the gear 214 meshes with the gear 215. For that reason, the ink ribbon R is taken up by the ribbon take-up spool 55.

Therefore, the operator can easily pull out the cartridge 59 simply by turning the lever 201 in the direction of the arrow X in FIG. 15 because the cartridge lock 201*a* that fastens the cartridge 59 is unlocked, and the thermal head 56 retreats by freeing the pressure toward the head holder 221, and the ink ribbon R is slackened.

Because pressure to the head holder 221 is freed, the head holder 221 can also be pulled out. When pulling this unit out, the operator manually lifts up the head holder pressing unit 223 thereby making it even easier to pull out the head holder 221. (See FIGS. 12 and 13.)

Install Operations

Conversely, when inserting the cartridge 59, the lever 201 is positioned at its unlocked position (see FIGS. 17 and 18); and the thermal head 56 (head holder 221) is also positioned at its retreated position. (See FIG. 19) The lever 201 is fastened at its unlocked state (see the state shown in FIG. 23) by the projections 201*b* mating with the concave portion 42*a* that has a moderate channel shape formed in the frame 40 (see FIG. 22) in the same way as the locking position, even at the unlocked position. The operator opens the cover 8 and inserts (or installs) the cartridge 59, then pulls the lever 201 and then turns it in the direction of the Y in FIG. 18 (an opposite direction to the arrow X direction in FIG. 15). The lever 201 is positioned at the locking position by the cartridge lock 201*a* touching the cartridge 59, and the cartridge 59 is then fastened in its installed state. In other words, the states shown in FIGS. 17 and 18, or the unlocked state, are shifted to the states shown in FIGS. 14 and 15, or the locked state.

Also, by the operator turning the lever 201 in the direction of the arrow Y in FIG. 18, the shaft 230 is rotated, and the head holder moving member 222 disposed on the shaft 230 moves in the direction of the arrow Y in FIG. 18. The head holder pressing unit 223 is linked to the head holder moving member 222 by the joint 224, so the head holder pressing unit 223 also moves in the arrow Y direction in FIG. 18 using the shaft 230 as the rotating shaft. At that time, the head holder pressing unit 223 moves to a state touching the pressed portion 221*a* of the head holder 221, so the head holder 221 moves in the direction of the platen roller 64 while the convex portions 221*c* move along the channel 41 in the frame 40. This shifts from the state shown in FIG. 19 to the one shown in FIG. 16. In this state, the head holder pressing unit 223 pushes the head holder 221 down in the direction of the platen roller 64 being disposed.

Therefore, the cartridge 59 is fastened at its installed position, and the thermal head 56 is set at the print idling position. The system enters a printing ready state by the operator simply turning the lever 201 in the direction of the arrow Y in FIG. 18. Note that the fan-shaped gear 211 disposed on the shaft 230 transmits drive force that is opposite to the ribbon take-up direction, but drive force is not transmitted to the ribbon take-up spool 55 because of the one-way clutch 216 provided on the gear 213. For this reason, when the cartridge 59 is set, drive force is not transmitted to the ribbon take-up spool 55, and there is no slack in the ink ribbon R of the cartridge 59.

Overall Operations

When power is charged to the control unit 95, the CPU reads programs and program data stored in ROM (and expands to RAM) and conducts an initializing process that operates each mechanism. Specifically, in the initializing process, the connections of each of the control units of the sensor control unit connected to the microcomputer via the external busses and that composes the control unit 95, and of the magnetic encoder unit 80 are checked. Then a decision is made based on signals from the sensor control unit whether each composing unit is at its home position. If they are not at their home positions, they are moved to their home positions. If, based on the signals of the sensor control unit, each composing element does not move to its home position after repeated attempts to return them to their home positions, the host apparatus is notified and a notice is made on the operation control display unit.

Also, in the initializing process, it is determined whether the cartridge 59 is installed based on a signal from the sensor control unit (detection sensor 26), and a recover operation is performed according to the results of that determination. That is described in detail with reference to FIGS. 8A to 8C.

Figure 8A:
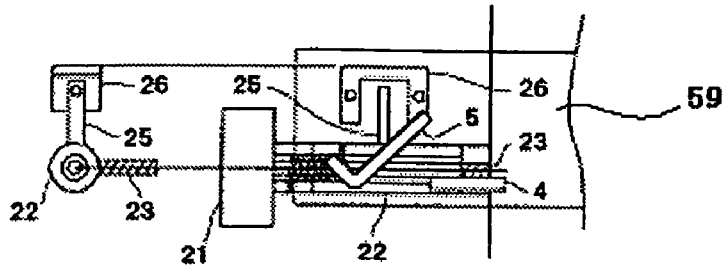
Figure 8B:
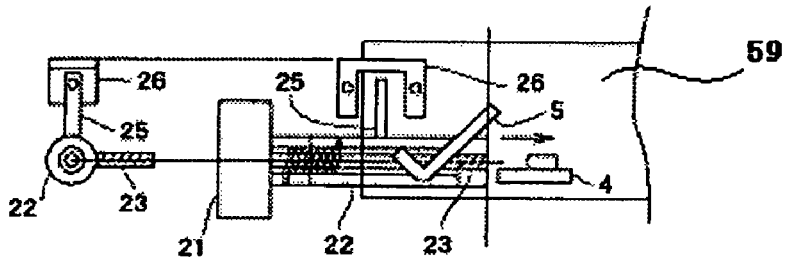
Figure 8C:
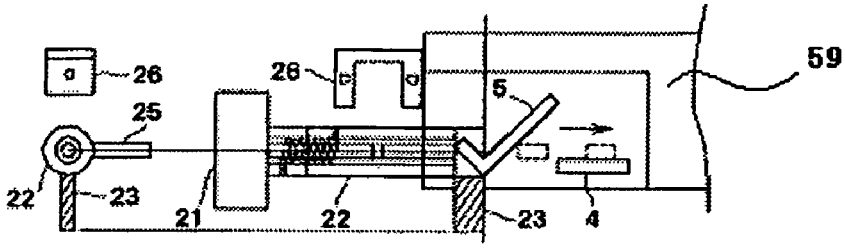

FIG. 8A shows the cartridge 59 installed in the apparatus, and the ink ribbon R positioned and ready to print. In this state, the locking member 23 of the main apparatus side stops at the stopper 4 of the cartridge 59, and the target member 25 is positioned at a first position shielding light of the detection sensor 26 (being detected by the detection sensor 26). FIG. 8B shows the cover 8 opened from the state shown in FIG. 8A and the installed cartridge 59 being pulled out. FIG. 8C shows the cartridge 59 pulled further out from the state shown in FIG. 8B. In other words, the locking member 23 is displacingly rotated from the stopping position by the guide 5 thereby unshielding the detection sensor 26 by the target member 25. In this state, the locking member 23 is not stopped at the stopper 4, and the target member 25 is moved to a second position where it is not detected by the detection sensor 26.

Figure 8D:
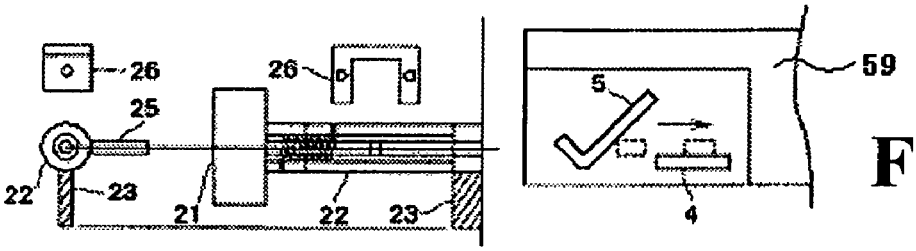
Figure 8E:
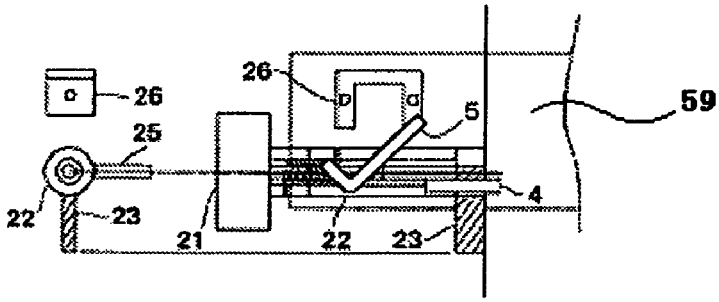

FIG. 8D shows the cartridge 59 pulled even further from the state shown in FIG. 8C and removed from the main apparatus. FIG. 8E shows the cartridge 59 removed from the main apparatus and replaced by a new ink ribbon, for example, and remounted in the main apparatus. In this state, the locking member 23 is not stopped at the stopper 4, and the target member 25 is kept at the second position where it is not detected by the detection sensor 26.

It should be particularly noted here that the difference of FIG. 8A where the cartridge 59 is installed to the apparatus and the system is ready for printing and FIG. 8E where a cartridge 59 is reinstalled is that the target member 25 is moved from the first position to the second position by the user (operator) installing the cartridge 59, and does not recover to the first position. The detection sensor 26 outputs a high level (ON) signal when the target member 25 is at the first position and outputs a low level signal (OFF) when the target member 25 is at the second position, but the opposite relationship is also acceptable.

In the initializing process, when the detection sensor 26 outputs a high level (when the target member 25 is at the first position), the CPU determines that the cartridge 59 has not been pulled out. When the detection sensor 26 outputs a low level (when the target member 25 is at the second position), the CPU determines that a cartridge 59 has been removed.

When the CPU determines that the cartridge 59 has been pulled out (when the locking member 23 and target member 25 are in the state shown in FIG. 8E), the motor (not shown) that drives the supply spool 54 and the take-up spool 55 is driven thereby rotating the shaft 22 connected to the drive link 21, and the locking member 23 stops at the stopper 4 of the cartridge 59. The target member 25 moves (recovers) from the second position to the first position.

At that time, the CPU monitors signals over a constant time output from an encoder plate (not shown) described above that integrally rotates with the rotation of the supply spool 54. If there is no signal from the encoder plate, the CPU determines that the cartridge 59 has not be reinstalled in the apparatus, stops drive of the motor (not shown), and notifies the host apparatus while displaying a message to that affect on the operation panel 5 display unit. When there is output from the encoder plate (not shown), it is determined that the cartridge 59 has been reinstalled in the apparatus, and the motor (not shown), continues to drive causing the ink ribbon R of the cartridge 59 to be taken up at the take-up spool 55.

The CPU uses a timing that the transmissive sensor composed of the light-emitting element 58 and light-receiving element 88 detects the edge of the ink layer Bk (black) (when the light-receiving element 88 detects a switch from a non-transmissive state of the light from the light-emitting element 58 caused by the ink layer Bk to a transmissive state), as a trigger to drive the motor (not shown) and conduct further a predetermined number of steps to cue the ink ribbon so that the leading edge of the ink layer Y (yellow) is positioned at the thermal head 56 and platen roller 64 position.

Next, the CPU references information written to EEPROM mounted on the ROM substrate 27 to determine whether the amount of ink ribbon R remaining in the cartridge 59 is enough to continue printing to the card 6. The cumulative rotation count of the encoder plate updated when printing of the printing unit 60 to the card 6 is completed as described below, and black and white and colors (not updated) on the ink ribbon R are recorded on the EEPROM as information. Note that when it is determined that the cartridge 59 has been reinstalled to the apparatus, the CPU initializes the cumulative rotation count (for example, it clears the count to zero) for the encoder plate recorded on the EEPROM prior to driving the motor (not shown), that rotatingly drives the supply spool 54 and take-up spool 55. When it is determined that printing is possible, the initialization process is continued. When printing is determined not to be possible, the host apparatus is notified. Furthermore, a message regarding that affect is displayed on the display unit on the operation panel, and the system idles until a new cartridge 59 is installed.

Note that the determination of the installation of the cartridge 59 and the recovery operation are also performed when the cover 8 has been opened once when the power to the apparatus is on, in addition to the initialization processes when the power to the apparatus is turned ON. In such a case, the CPU determines that there has been a change from ON (the cover 8 is open) to OFF (the cover 8 is closed) in the output of the cover sensor (not shown), that detects the status of the cover 8 (whether the cover is open or closed) and when there is a negative determination.

Also, in the initializing process, it is determined whether a card is stored in the card supply unit 3 based on signals from the sensor control unit (empty sensor). If there is no card, in the same way as described above, the host apparatus is notified and a message is displayed on the display unit of the operation panel 5. The system then idles until a card 6 is stored in the card supply unit 3.

A printer driver installed in the host apparatus determines various parameters to control the recording operation at the printer apparatus 1 based on recording instructions specified by an operator, then generates print recording data to record to the card 6 and magnetic recording data using the recording instructions. Those are sent to the printer apparatus 1. Parameter values for the recording control instructions, image data and character data attained by disassembling print recording data into the color components of Y, M, C and Bk and magnetic recording data are stored in the buffer memory of the control unit 95. Note that with this embodiment, data is disassembled into its color components (the original data is R, G, B) at the host apparatus and the disassembled data is converted from R, G, B to Y, M, C at the printer apparatus 1 and used as the image data. Bk data extracted at the host apparatus is used as Bk data in the same way at the printer apparatus 1 to be character data.

The CPU reads the recording control instruction (parameter values) stored in the buffer memory to control each mechanism according to the parameter values, program and program data expanded to RAM as follows.

Initially, the actuator 101 (solenoid 101*a*) is driven (turned ON) via the actuator control unit to move the cleaning roller 35 from its retreated position (home position) to the operating position shown in FIG. 2 to prepare to receive the card 6. At that time, the moving mechanism 110 positions the conveyance rollers 61 and 62 at the first position (home position) to form a substantially horizontal card conveyance path. (See the states shown in FIGS. 2 and 9.)

Next, the CPU operates the conveyance drive motor 70 via the actuator control unit to drive each of the rollers disposed on the card conveyance path P1 via the drive transmission mechanism and forward drives a motor (not shown), to rotatingly drive the supply roller 11 via the actuator control unit.

This conveys the lowermost card 6 of the supply tray 3 between the supply roller 12 and the separating gate 13 and into the casing 7 via the card supply opening 14. The printing surface of the card 6 is cleaned by the cleaning roller 35, and the card 6 is conveyed along the card conveyance path P1 toward the card conveyance out outlet 82. (See FIG. 2.) When the trailing edge of the card 6 is detected by the first card detection sensor, the CPU uses that card trailing edge detection as a trigger to stop (turn OFF) the drive of the actuator 101 (solenoid 101*a*). The cleaning roller 35 is freed by a pressing action of the lever member 103 and is moved from the operating position to the retreated position which is the home position shown.

The card 6 is conveyed by the conveyance drive motor 70 over the card conveyance path P1 toward the card discharge out outlet 82 until both ends of the card 6 are at a position where they are nipped by the feed roller 66 and the nip roller 65. The CPU stops the conveyance drive motor 70 after the card leading edge detection from the second card detection sensor when the number of pulses of the conveyance drive motor 70 reaches a predetermined value. This stops and holds the card 6 with both edges in a nipped state by the feed roller 66 and the nip roller 65. The card 6 is then in a state where magnetic recording data can be written to the magnetic strip by the magnetic head 81 of the magnetic encoder unit 80.

The CPU drives the direct current motor with the encoder (not shown) to move the magnetic head 81 from its home position to the operating position in order to write information to the magnetic strip on the card 6, and pressingly touches the magnetic head 81 against the magnetic strip on the card 6.

Next, the CPU outputs magnetic recording data stored in the buffer memory to the magnetic encoder unit 80 via the external bus, and drives the direct current motor equipped with an encoder (not shown) thereby moving the magnetic head 81 within the necessary region over the entire region from one edge to the other on the magnetic strip on the card 6 to record the magnetic recording information on the magnetic strip.

When the process to write the magnetic recording information to the magnetic strip on the card C is complete, the CPU stops the direct current motor equipped with an encoder (not shown) and reverses its drive to read the magnetic recording information written to the magnetic strip on the card 6. This is to verify that the magnetic recording data stored in the buffer memory matches the magnetic recording data recorded in the magnetic strip on the card 6. (This is a check that the data was written correctly.) Note that when this verification process is complete, the magnetic head 81 returns to its home position.

In the event that the results of the verification show that the data was written incorrectly, the CPU notifies the host apparatus 100 and displays a message to that affect on the display unit 4. By driving the conveyance drive motor 70 a predetermined number pulses (in the forward direction) the card 6 is conveyed out of the apparatus via the card conveyance outlet 82. Next, a new card 6 is supplied from the supply tray 3. In the same way, the magnetic encoder unit 80 writes magnetic recording data to the magnetic strip on the new card 6 and verifies that it is correctly written.

In a case where there is no problem as to the results of the verification from the microcomputer of the magnetic encoder unit 80 (when magnetic recording data is correctly written to the magnetic strip on the card 6), the CPU drives the conveyance drive motor 70 in reverse. This operation conveys the card 6 stopped with both edges nipped by the nip roller 65 and the feed roller 46 in a reverse direction to the card supply opening 14 along the card conveyance path P1. While the card 6 is being conveyed in the reverse direction, the trailing edge of the card 6 is detected by the first card detection sensor. At that time, the conveyance drive motor 70 continues to drive in the reverse direction for a predetermined number of pulses and then stops its drive. This causes latter half of the card 6 in the conveyance direction to be stopped and held in a nipped state by the conveyance rollers 62 and 63, and the half-way portion from the trailing edge of the card 6 in the conveyance direction to be supported by the conveyance roller 61. (See FIG. 2)

Next, the CPU drives the conveyance drive motor 70 in the forward direction to convey the card 6 toward the card conveyance outlet 82 over the card conveyance path P1 and at the same time verify the position of the leading edge of the card 6 using the first card detection sensor and prints predetermined characters and images on the surface of the card 6 according to the print recording data using the printing unit 60. Specifically, the thermal head 56 presses against the card 6 surface with the ink ribbon R (the ink layer Y portion) interposed therebetween and selectively activates heating elements of the thermal head according to image data of the color Y (image data whose Y component was converted from the RGB data). This operation directly transfers the thermal transfer ink component of Y (yellow) coated on the ink ribbon R to the surface of the card 6.

At that time, the backside of the card 6 is supported by the platen roller 64, but initially it is nippingly conveyed by the conveyance rollers 62 and 63 toward the card conveyance outlet 82 over the card conveyance path P1. The leading edge of the card C is nippingly conveyed by the nip roller 65 and the trailing edge of the card C is nippingly conveyed by the conveyance roller 63, and finally it is nippingly conveyed by the nip roller 65 (while the backside of the trailing edge of the card C is supported by the platen roller 64). The CPU checks the position of the trailing edge of the card 6 with the first card detection sensor, and continues to drive the conveyance drive motor 70 in the forward direction for a predetermined number of pulses and then the drive of the conveyance drive motor 70 is stopped.

Next, the CPU drives the conveyance drive motor 70 in reverse to convey the card 6 in reverse along the card conveyance path P1 to the card supply opening 14. The card 6 is stopped and held with the back half in the conveyance direction in a nipped state by the conveyance rollers 62 and 63 and the front half in the conveyance direction supported by the conveyance roller 61. At that point the drive of the conveyance drive motor 70 is stopped. (See FIG. 2) During this time, the CPU drives a motor (not shown) to slightly wrap the ink ribbon R of the cartridge 59 to the take-up spool 55 so that the leading edge of the ink layer M (magenta) is positioned at the thermal head 56 and platen roller 64 position.

Next, the CPU drives the conveyance drive motor 70 in the forward direction to convey the card 6 along the card conveyance path P1 toward the card conveyance outlet 82 and directly transfers the thermal transfer ink component of the ink layer M (magenta) coated on the ink ribbon R to the surface of the card 6. In the same way, the CPU directly transfers the thermal transfer ink components of the ink layers C (cyan) and Bk (black) coated on the ink ribbon R to the surface of the card 6 using the printing unit 60. This operation creates a color image on the surface of the card 6 using the colors of Y, M, C and Bk.

Subsequently, the CPU conveys the card 6 toward the discharge outlet 34. Specifically, when the conveyance drive motor 70 is driven in reverse, the card 6 is conveyed along the card conveyance path P1 in reverse toward the card supply opening 14. As shown in FIG. 2, when sequentially print recording multiple colors onto the print surface of the card 6 using the printing unit 60, the conveyance rollers 61 and 62 are kept at the first position positioned to form a substantially level card conveyance path when the card 6 is being conveyed in reverse to the card supply opening 14. However, when the card 6 has completed predetermined recording processes and is being conveyed toward the card discharge outlet 34, using the point where the first card detection sensor detects the trailing edge of the card 6 being conveyed in reverse over the card conveyance path P1, or when using the detection of the trailing edge of the card 6 as a trigger and the card 6 is conveyed further a predetermined number of pulses, the CPU controls the drive of the stepping motor 111 so the moving mechanism 110 (drive from the stepping motor 111) moves the conveyance rollers 61 and 62 to the second position positioned where they form an oblique card conveyance path (see the state in FIG. 3), and drives a motor (not shown) in reverse to rotatingly drive the supply roller 11 and rotatingly drives the discharge roller 15.

With these processes, the card 6 will be either stored in the discharge tray 2 via the discharge outlet 34, or discharged from the card discharge outlet 24 to outside the apparatus (when the discharge tray 2 is full of cards). Note that when the card is discharged as shown in FIG. 3, the cleaning roller 35 is positioned at its retreated position that is its home position separated from the card conveyance path P1.

At the point when the CPU either stores the card 6 in the discharge tray 2 or discharges it from the card discharge outlet 24, the reverse drives of the conveyance drive motor 70 and the motor (not shown) are stopped. Note that the CPU drives the stepping motor 111 again (rotatingly driven in an opposite direction) at the predetermined timing when the discharge operation of the card 6 to the discharge tray 2 has been completed in order to recover the conveyance rollers 61 and 62 from the second position positioned to form an oblique card conveyance path to the first position positioned to form a substantially level card conveyance path.

The CPU updates the cumulative number of rotation of the EEPROM encoder plate in addition to the total number of rotation that the encoder plate rotates through printing at the printing unit 60 to the cumulative number of rotation of the encoder plate read from the EEPROM on the ROM substrate 27, in the initializing process. This completes the recording processes to the card 6. If there is a subsequent job, the operations described above are repeated.

The following will describe the effects of the printer apparatus 1 of this embodiment.

With the printer apparatus 1 of this embodiment, when the cartridge 59 is installed in the apparatus, the locking member 23 is stopped at the stopper 4 on the cartridge 59, and the detection sensor detects the target member 25 located at the first position (see FIG. 8A), and the CPU determines that the cartridge 59 has not been pulled out. Conversely, if the cartridge 59 has been removed from the apparatus, and when a cartridge 59 is reinstalled in the apparatus, the locking member 23 enters a non-stopped state at the stopper 4 on the cartridge 59, and the target member 25 is maintained at the second position (see FIG. 8E), so the detection sensor 26 does not detect the target member 25, and the CPU determines that the cartridge 59 has been removed. Therefore, with the printer apparatus 1 of this embodiment, it is possible to securely detect that the cartridge 59 has been installed into or removed from the apparatus because the state does not immediately recover to the state prior to the installation operation as with the prior art when the cartridge 59 is reinstalled. (In other words, the non-target member 25 is maintained at the second position.)

Also, with the printer apparatus 1 of this embodiment, the ink ribbon R is not positioned when it is determined that the cartridge 59 has not been removed (it remains in place), and the ink ribbon R is positioned when it is determined that the cartridge 59 has been reinstalled. Therefore, with the printer apparatus 1 of this embodiment, it is possible to suppress unnecessary positioning that is performed each time the power is turned on, as is the case with the prior art, so the ink ribbon R in the cartridge 59 is more effectively utilized, and running costs can be reduced.

Figure 10:
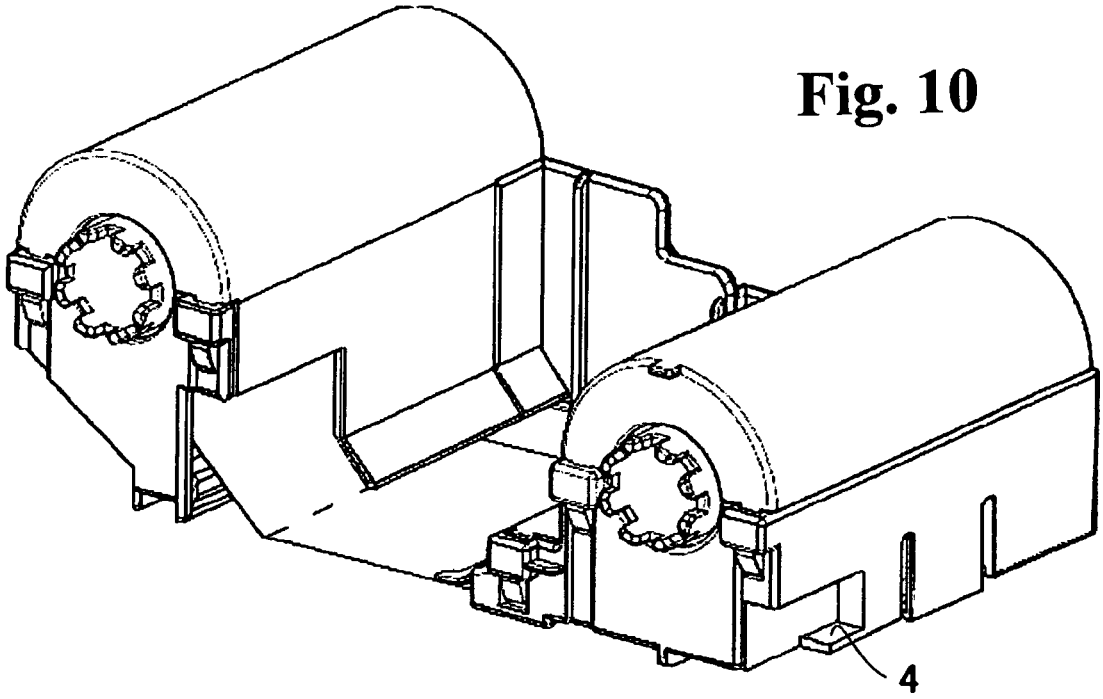
FIG. 10 is an external perspective view of another embodiment of the cartridge.

Note that with this embodiment, an example was provided with a guide obliquely arranged with a flat, plate-shaped stopper 4 on the cartridge 59, but the present invention should not be construed to be limited thereto. For example, it is acceptable to configure the cartridge 59 without the guide 5, as shown in FIG. 10.

Figure 11:
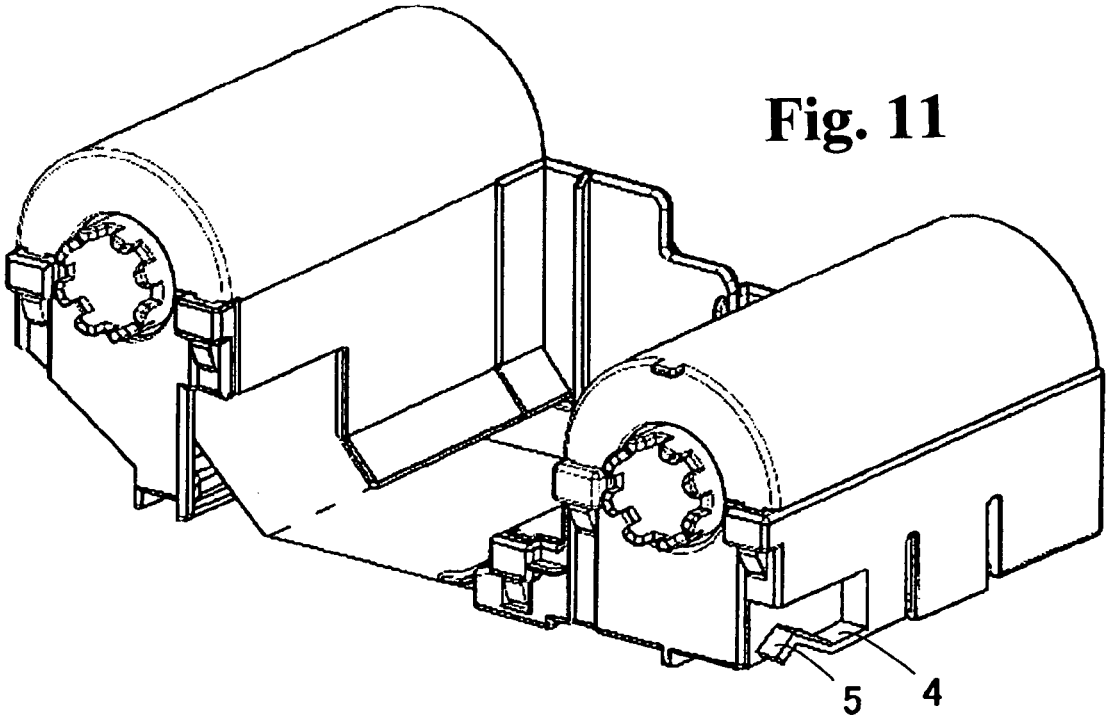
FIG. 11 is an external perspective view of another embodiment of the cartridge.

An example was provided with this embodiment for the locking member 23 to be forcefully moved downward by the guide 5 of the cartridge 59, but as shown in FIG. 11, it is acceptable to idle the locking member 23 upward by reversing the shape of the guide 5, or to integrally forming the stopper 4 and guide 5 on the cartridge 59.

Figure 12:
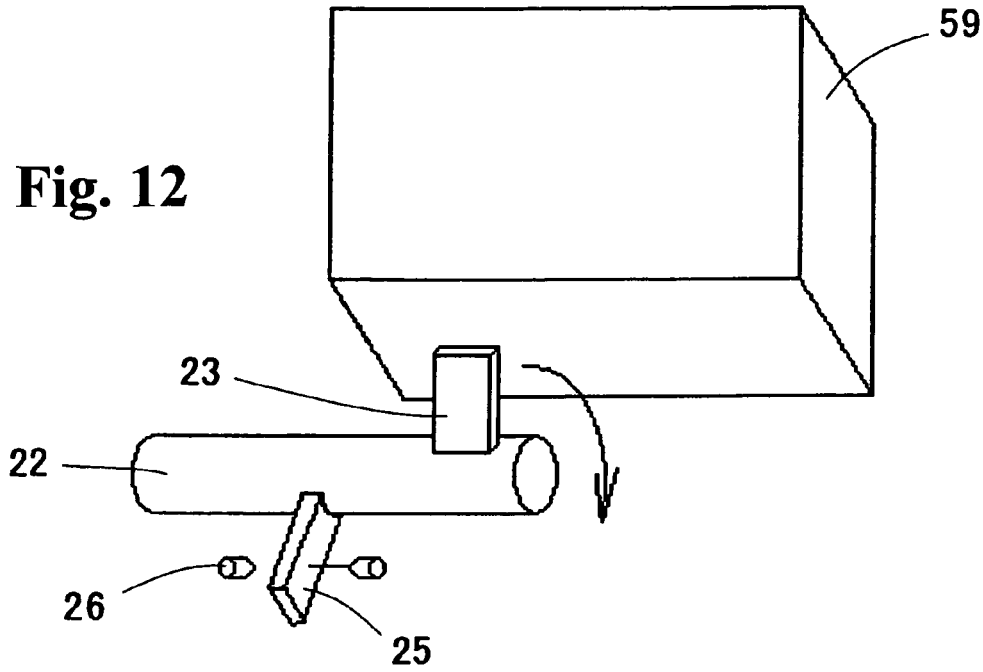
FIG. 12 is an external perspective view of still another embodiment of the cartridge.

Still further, with this embodiment, an example was provided to stop (engage) the locking member 23 at the stopper 4, but as shown in FIG. 12, it is acceptable to stop the locking member 23 by touching the cartridge case of the cartridge 59. With this embodiment, the locking member 23 is forcefully moved downward by the guide 5 on the cartridge 59, but it is also acceptable to eliminate the guide 5 on the cartridge 59 by allowing the action of the spring clutch that acts on the locking member 23 to release and rotate under its own weight (see the arrow in FIG. 12).

The embodiment is provided with an example where the stopper 4 is fastened to the cartridge case of the cartridge 59, but it is also acceptable to establish a level 28 for linking to a bracket 31 having a stopper on the other side and urged on one side by the spring 29, to one of a pair of spools (for example a take-up spool) of the ribbon unit; touch the level 28 to an arc-shaped portion formed in the bracket 31 so that the level 28 touches the arc portion of the bracket 31 and is thereby advanced to a position where it can stop the locking member 23; and retreat to a position where it cannot stop the locking member 23 at a non-contact position with the level 28 (unlinked).

Figure 13:
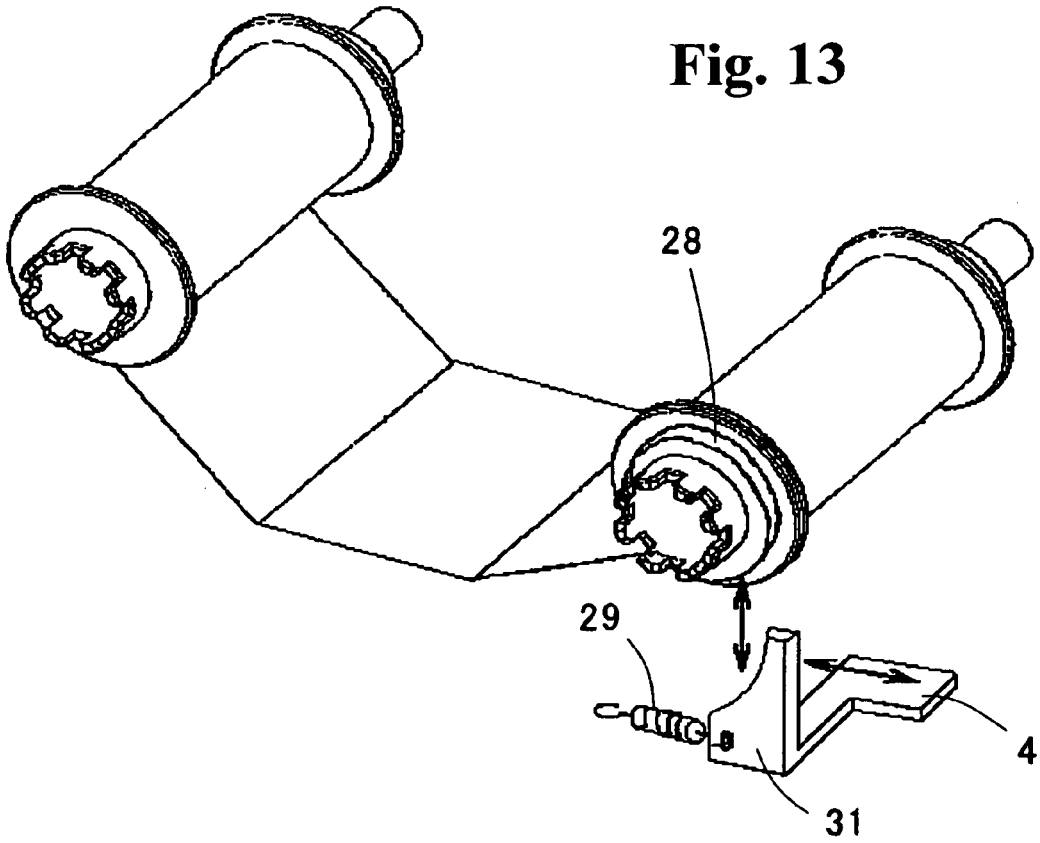
FIG. 13 is an external perspective view of another embodiment of the ink ribbon housed in the cartridge.

Still further, an example was provided with this embodiment to install the cartridge 59 in the printer apparatus 1, with the ink ribbon installed in the cartridge 59. However, it is not necessary to use a cartridge 59, but to directly install the ink ribbon in the printer apparatus 1. In this case, as shown in FIG. 13, a bracket 31, of which one side is urged by a spring 29 and which has the stopper 4 at the other side, is provided on the printer apparatus 1, and a level 28 that links with the bracket 31 is provided on the pair of spools of the ink ribbon on the other side (for example the take-up spool). Also, by installing the ink ribbon in the printer apparatus 1, and touching (linking) the level 28 to the arc portion formed in the bracket 31, the stopper is advance to a position where the locking member 23 can stop at the stopper 4. The ink ribbon can be removed from the printer apparatus 1, and the level 28 is in a non-contact (unlinked) state with the arc portion formed on the bracket 31, so the locking member 23 is positioned where it cannot be stopped by the stopper 4. Therefore, the same affect as a configuration to retreat the stopper 3 is attained.

Also, in this embodiment, an example is provided for a transmissive type sensor for the detection sensor 26. However, the present invention is not limited to this configuration and can also adopt a reflective type sensor, for example. Also, with this embodiment, an example was provided with the shaft 22 as a member to link the locking member 23 and target member 25. However, the present invention should not be construed to be limited thereto. Rotating bodies, such as gears can also be used.

The disclosure of Japanese Patent Application No. 2007-015205, filed on Jan. 25, 2007 and Japanese Patent Application No. 2007-021434, filed on Jan. 31, 2007 are incorporated as references.

While the invention has been explained with reference to the specific embodiments of the invention, the explanation is illustrative and the invention is limited only by the appended claims.

What is claimed is:

1. A printer apparatus for detachably attaching a cartridge with an ink ribbon for printing characters and images on a recording media, said printer apparatus comprising:

a detection sensor for detecting an installation of the cartridge;

a locking member for locking the cartridge;

a target member detected by the detection sensor when the locking member is locked to the cartridge, and integrally moving with the locking member;

driving means for moving the locking member and the target member; and determining means for determining the installation of the cartridge according to output of the detection sensor, wherein, when the cartridge is pulled from the printer apparatus, the locking member is unlocked from the cartridge, and the target member is moved from a first position where it is detected by the detection sensor to a second position where it is undetected by the sensor, the target member stays in the second position, and the locking member is not locked to the cartridge when the cartridge is being installed in the printer apparatus, the determining means determines that the cartridge has not been pulled out when the target member at the first position is detected by the detection sensor, and that the cartridge has been pulled out when the target member is not detected by the detection sensor, and when the determining means is operated and determines that the cartridge has been pulled out, the driving means is operated to move the locking member to lock the cartridge being installed in the printer apparatus and the target member from the second position to the first position.

2. A combination comprising the printer apparatus according to claim 1 and the cartridge, wherein the cartridge has a locking portion for locking the locking member when the cartridge is installed in the printer apparatus.

3. A combination comprising the printer apparatus according to claim 1, and the cartridge, wherein the cartridge further comprises a guide forcefully guiding the locking member to shift from a locked state to an unlocked state when the cartridge is pulled from the printer apparatus.

4. A combination comprising the printer apparatus according to claim 1 and the cartridge, wherein the ink ribbon includes bands of a plurality of colors, and a predetermined color on the ink ribbon of the cartridge is positioned at a predetermined position when the determining means determines that the cartridge has been removed.

5. A printer apparatus according to claim 1, wherein in an initializing process of the printer apparatus, the driving means is actuated to move the locking member and the target member without actuating when the cartridge is being installed in the printer apparatus.

6. A printer apparatus according to claim 5, wherein the driving means is a member for rotating the locking member and the target member.

7. A combination comprising a cartridge with an ink ribbon, and a printer apparatus for detachably attaching the cartridge for printing characters and images on a recording media, wherein said printer apparatus comprises:

a detection sensor for detecting an installation of the cartridge;

a locking member for rotatably locking the cartridge;

a target member detected by the detection sensor when the locking member is locked to the cartridge and integrally rotating with the locking member; and determining means for determining the installation of the cartridge according to output of the detection sensor, wherein, when the cartridge is pulled from the printer apparatus, the locking member is unlocked from the cartridge, and the target member is moved from a first position where it is detected by the detection sensor to a second position where it is undetected by the sensor, the target member stays in the second position, and the locking member is not locked to the cartridge when the cartridge is being installed in the printer apparatus, the determining means determines that the cartridge has not been pulled out when the target member at the first position is detected by the detection sensor, and that the cartridge has been pulled out when the target member is not detected by the detection sensor, and said printer apparatus further comprises rotating means for rotating the locking member and the target member so that the locking member is locked to the cartridge in the printer apparatus, and the target member is positioned at the first position when the determining means determines that the cartridge has been pulled out, and wherein the cartridge includes an ink ribbon unit detachable to the cartridge, said ink ribbon unit comprising the ink ribbon, a supply spool for supplying the ink ribbon, and a take-up spool for retrieving the ink ribbon;

the locking portion is attached to the cartridge and movable forward and backward;

the locking portion advances to a position where the locking member can lock by installing the ink ribbon unit to the cartridge; and the locking portion retreats to a position where the locking member cannot lock by removing the ink ribbon unit from the cartridge.

8. A printer apparatus for printing images and characters to a recording medium with an ink ribbon unit including an ink ribbon, a supply spool for supplying the ink ribbon, and a take-up spool for retrieving the ink ribbon, said printer apparatus comprising:

a detection sensor for detecting an installation of the ink ribbon unit;

a locking portion moved by an installation of the ink ribbon unit;

a locking member rotatably engaging the locking portion;

a target member integrally moving with the locking member and detected by the detection sensor when the locking member is locked to the locking portion;

driving means for moving the locking member and the target member; and determining means for determining the installation of the ink ribbon unit according to output of the detection sensor, wherein the locking member is unlocked from the locking portion, and the target member is moved from a first position where it is detected by the detection sensor to a second position where it is undetected by the sensor when the ink ribbon unit is pulled from the printer apparatus;

when the ink ribbon unit is installed in the printer apparatus, the locking member is not locked on the locking portion and the target member stays in the second position;

the determining means determines that the ink ribbon unit has not been pulled out when the target member at the first position is detected by the detection sensor, and determines that the ink ribbon unit has been pulled out when the target member is not detected by the detection sensor, and when the determining means is operated and determines that the ink ribbon unit has been pulled out, the driving means is operated to move the locking member to lock the ink ribbon unit being installed in the printer apparatus and the target member from the second position to the first position.

9. A printer apparatus according to claim 8, wherein in an initializing process of the printer apparatus, the driving means is actuated to move the locking member and the target member without actuating when the ink ribbon unit is being installed in the printer apparatus.

10. A printer apparatus according to claim 9, wherein the driving means is a member for rotating the locking member and the target member.

* * * * *